US010634389B2

(12) United States Patent
Moriyama et al.

(10) Patent No.: US 10,634,389 B2
(45) Date of Patent: Apr. 28, 2020

(54) REFRIGERATION CYCLE APPARATUS

(71) Applicant: Mitsubishi Electric Corporation, Chiyoda-ku (JP)

(72) Inventors: Takashi Moriyama, Chiyoda-ku (JP); Hiroki Murakami, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 0 days.

(21) Appl. No.: 15/776,091

(22) PCT Filed: Jun. 28, 2016

(86) PCT No.: PCT/JP2016/069143

§ 371 (c)(1),
(2) Date: May 15, 2018

(87) PCT Pub. No.: WO2017/122373

PCT Pub. Date: Jul. 20, 2017

(65) Prior Publication Data

US 2018/0328626 A1 Nov. 15, 2018

(30) Foreign Application Priority Data

Jan. 14, 2016 (JP) ..... 2016-005504

(51) Int. Cl.
*F25B 1/04* (2006.01)
*F25B 43/02* (2006.01)
(Continued)

(52) U.S. Cl.
CPC ..... *F25B 1/04* (2013.01); *F25B 1/00* (2013.01); *F25B 31/004* (2013.01); *F25B 41/04* (2013.01);
(Continued)

(58) Field of Classification Search
CPC .. F25B 1/00; F25B 43/02; F25B 41/04; F25B 2400/02
See application file for complete search history.

(56) References Cited

U.S. PATENT DOCUMENTS 2,223,882 A * 12/1940 Beline ..... F25B 31/004 62/84
2009/0133435 A1* 5/2009 Toyoshima ..... F25B 31/004 62/473
2016/0209088 A1* 7/2016 Shimazu ..... F25B 31/004

FOREIGN PATENT DOCUMENTS

JP 2011-196594 A 10/2011
WO WO 2015/045011 A1 4/2015
WO WO 2016/121184 A1 8/2016

OTHER PUBLICATIONS

Extended European Search Report dated Nov. 8, 2018 in European Patent Application No. 16884976.8, 9 pages.
(Continued)

*Primary Examiner* — Elizabeth J Martin
(74) *Attorney, Agent, or Firm* — Oblon, McClelland, Maier & Neustadt, L.L.P.

(57) ABSTRACT

A refrigeration cycle apparatus includes: a refrigerant circuit including a compressor, a condenser, an expansion device, and an evaporator; an oil separator provided at a refrigerant discharge side of the compressor and configured to separate refrigerant and a refrigerating machine oil; a first oil return path connecting the oil separator to a refrigerant suction side of the compressor; a flow control device provided on the first oil return path and configured to reduce pressure of the refrigerant and the refrigerating machine oil; an oil reservoir provided to branch from the first oil return path between the flow control device and the refrigerant suction side of the compressor and configured to store the refrigerating machine oil; a second oil return path on which the oil
(Continued)

reservoir is provided and through which the oil accumulated in the oil reservoir flows when being returned to the compressor.

11 Claims, 14 Drawing Sheets

(51) Int. Cl.
*F25B 1/00* (2006.01)
*F25B 31/00* (2006.01)
*F25B 41/04* (2006.01)
*F25B 49/02* (2006.01)

(52) U.S. Cl.
CPC ..... *F25B 43/02* (2013.01); *F25B 49/022* (2013.01); *F25B 2400/04* (2013.01); *F25B 2500/26* (2013.01); *F25B 2600/23* (2013.01); *F25B 2600/2515* (2013.01)

(56) References Cited

OTHER PUBLICATIONS

International Search Report dated Sep. 13, 2016 in PCT/JP2016/069143, filed on Jun. 28, 2016.
Combined Office Action and Search Report dated Nov. 21, 2019 in Chinese Patent Application No. 201680077896.0 (with English translation and English translation of categories of cited references).

* cited by examiner

REFRIGERATION CYCLE APPARATUS

TECHNICAL FIELD

The present invention relates to a refrigeration cycle apparatus including a mechanism for returning refrigerating machine oil to a compressor.

BACKGROUND ART

A refrigeration cycle apparatus includes, for example, a compressor that compresses and discharges refrigerant. In the case where the compressor is, for example, a scroll compressor or the like, the compressor has a structure in which a refrigerating machine oil is supplied to each sliding portion, such as a bearing for supporting a motor that makes rotational motion, a conversion mechanism portion that converts the rotational motion to oscillatory motion, and a contact surface between an orbiting scroll and a fixed scroll, such that the sliding portion is not worn due to friction. Thus, the refrigerating machine oil is stored in the compressor such that the supply of the refrigerating machine oil is not interrupted.

Here, while the compressor is operating, the refrigerating machine oil flows out via a discharge pipe together with the refrigerant. When the refrigerating machine oil flows out from the compressor, the refrigerating machine oil remains in components that form a refrigerant circuit of the refrigeration cycle apparatus, such as pipes and a heat exchanger. When the refrigerating machine oil within the compressor flows out as described above, the refrigerating machine oil within the compressor may become insufficient, which causes poor lubrication of a compression mechanism portion.

A refrigeration cycle apparatus has been proposed in which a mechanism to separate discharged refrigerating machine oil by an oil separator and return the refrigerating machine oil to the suction side of a compressor is used for preventing poor lubrication of each sliding portion of the compressor. Here, immediately after the compressor is started, the amount of the refrigerating machine oil flowing out from the compressor is increased as compared to that during continuous operation. This is because, immediately after the compressor is started, liquid refrigerant within the compressor rapidly vaporizes to foam, and the refrigerating machine oil flows out together with the refrigerant.

The time of contiguous operation refers to the time during which a preset time period has elapsed and operation of the compressor has been stabilized after the compressor is started, not the time immediately after the compressor is started. It is assumed that even when the oil separator is provided in the refrigeration cycle apparatus, the refrigerating machine oil overflows from the oil separator and flows out through a pipe through which the refrigerant flows.

Thus, as an existing refrigeration cycle apparatus, a refrigeration cycle apparatus has been proposed in which an oil return pipe line opened during continuous operation and an oil return pipe that is mounted on a lower portion of an oil separator, that includes an oil reservoir portion for storing oil during continuous operation, and that is opened during start to return the oil are connected to the oil separator (see, for example, Patent Literature 1). In the refrigeration cycle apparatus disclosed in Patent Literature 1, since the aforementioned oil return pipe line and the oil return pipe including the oil reservoir portion are included, the oil stored in the oil reservoir portion before the time of start easily returns to the suction side, due to a pressure difference, immediately after the start, so that insufficiency of lubricating oil within a compressor is inhibited.

CITATION LIST

Patent Literature

Patent Literature 1: International Publication No. 2015/045011

SUMMARY OF INVENTION

Technical Problem

In the refrigeration cycle apparatus disclosed in Patent Literature 1, part of the high-temperature refrigerating machine oil separated by the oil separator accumulates in the oil reservoir portion during continuous operation. Thus, heat moves from the oil reservoir portion to low-temperature outdoor air via a pipe and a container of the oil reservoir portion, so that the temperature in the oil reservoir portion decreases. The refrigerating machine oil within the oil reservoir portion is stored in the oil reservoir portion without the pressure thereof being reduced after the separation by the oil separator. Thus, the interior of the oil reservoir portion is made into low temperature and high pressure, and the refrigerant is liquefied or dissolved into the refrigerating machine oil, so that the refrigerant easily accumulates in the oil reservoir portion.

When the refrigerant accumulates in the oil reservoir portion, the amount of the oil stored therein is decreased. When the compressor is started, the amount of the refrigerating machine oil supplied from the oil reservoir portion into the compressor is decreased, so that the amount of the refrigerating machine oil required for lubrication cannot be ensured within the compressor, or the size of the oil reservoir portion is increased for supplying the required amount of the oil into the compressor.

In addition, since the refrigerant accumulates in the oil reservoir portion during continuous operation, the amount of the refrigerant required for the entire refrigeration cycle apparatus is increased.

The present invention has been made to solve the above-described problems, and an object of the present invention is to provide a refrigeration cycle apparatus that does not put a squeeze on the capacity of the refrigeration cycle apparatus and less increases a refrigerant amount even when a configuration in which a required amount of refrigerating machine oil is supplied into a compressor when the compressor is started is used in the refrigeration cycle apparatus.

Solution to Problem

A refrigeration cycle apparatus according to an embodiment of the present invention includes: a refrigerant circuit including a compressor, a condenser, an expansion device, and an evaporator; an oil separator provided at a refrigerant discharge side of the compressor and configured to separate refrigerant and a refrigerating machine oil; a first oil return path connecting the oil separator to a refrigerant suction side of the compressor; a flow control device provided on the first oil return path and configured to reduce pressure of the refrigerant and the refrigerating machine oil; an oil reservoir provided so as to branch from the first oil return path between the flow control device and the refrigerant suction side of the compressor and configured to store the refrigerating machine oil; a second oil return path on which the oil reservoir is provided and through which the oil accumulated in the oil reservoir flows when being returned to the compressor; a first opening and closing device provided on the first oil return path or the second oil return path and configured to control flow of the refrigerant and the refrigerating machine oil; and a controller configured to control the first opening and closing device to return the refrigerating machine oil via the second oil return path to the refrigerant suction side of the compressor.

Advantageous Effects of Invention

In the refrigeration cycle apparatus according to the embodiment of the present invention, during continuous operation, even when the refrigerant becomes less likely to accumulate in the oil reservoir and the oil reservoir has a small capacity, it is possible to accumulate the refrigerating machine oil in a required amount. Thus, it is possible to provide a refrigeration cycle apparatus that does not put a squeeze on the capacity of the refrigeration cycle apparatus and less increases a refrigerant amount even when a configuration in which refrigerating machine oil is supplied into a compressor when the compressor is started is used in the refrigeration cycle apparatus.

DESCRIPTION OF EMBODIMENTS

Figure 1A:
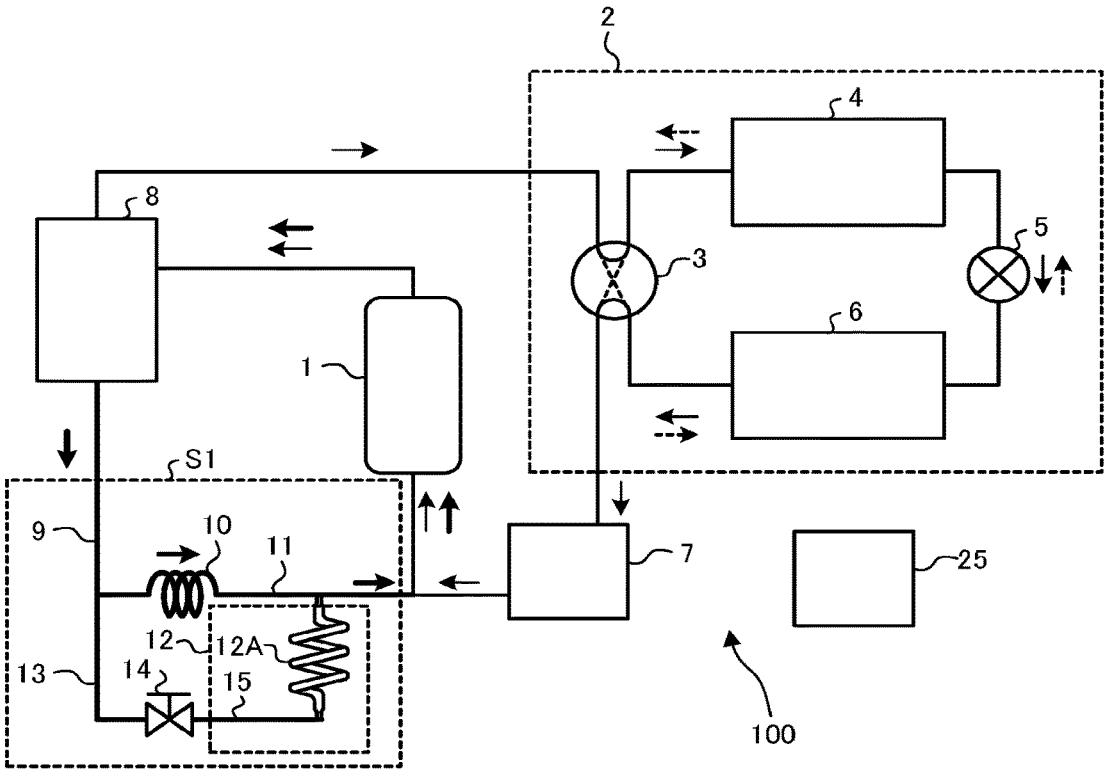
FIG. 1A is a schematic configuration diagram of a refrigeration cycle apparatus 100 according to Embodiment 1 of the present invention.

Hereinafter, embodiments of the refrigeration cycle apparatus according to the present invention will be described with reference to the drawings. It should be noted that Embodiments of the drawings are examples and are not intended to limit the present invention. Furthermore, the relationship of the size of each component in the drawings described below may be different from actual relationship.

Embodiment 1

FIG. 1A is a schematic configuration diagram of a refrigeration cycle apparatus 100 according to Embodiment 1 of the present invention. Solid lines connecting each component in the drawing show pipes. Arrows in the drawing show flow of a fluidity during operation of the refrigeration cycle apparatus 100, and thin solid lines and broken lines show flow of refrigerant. Thin solid arrows and broken arrows show that operation is switched between heating and cooling and the direction of flow of the refrigerant is changed. In addition, thick solid arrows show flow of refrigerating machine oil containing refrigerant gas.

[Description of Configuration of Refrigeration Cycle Apparatus 100]

The refrigeration cycle apparatus 100 according to Embodiment 1 will be described. The refrigeration cycle apparatus 100 according to Embodiment 1 has a configuration corresponding to, for example, an air-conditioning apparatus, a refrigerator, a freezer, a bending machine, and a water heater.

The refrigeration cycle apparatus 100 has a refrigerant circuit including: a compressor 1 that compresses and discharged sucked refrigerant; a refrigerant flow path switching device 3 that switches a refrigerant flow path; a first heat exchanger 4 that serves as a condenser or an evaporator; a second heat exchanger 6 that serves as an evaporator or a condenser; an expansion device 5 that reduces the pressure of the refrigerant; and an accumulator 7 that stores excess refrigerant.

In Embodiment 1, the refrigerant flow path switching device 3, the first heat exchanger 4, the second heat exchanger 6, the expansion device 5, refrigerant pipes that connect these components, and the like form a refrigerant main pipe line 2.

The compressor 1 is connected at the refrigerant discharge side thereof to an oil separator 8 and is connected at the refrigerant suction side thereof to the accumulator 7 and a later-described oil return portion S1. The compressor 1 may be composed of, for example, an inverter compressor that is able to control a rotation speed thereof.

The refrigerant flow path switching device 3 may be composed of, for example, a four-way valve or the like. Here, it is assumed that the first heat exchanger 4 is a heat source side heat exchanger provided in an outdoor unit or the like and the second heat exchanger 6 is a use side heat exchanger provided in an indoor unit or the like. In this case, during heating operation, the refrigerant flow path switching device 3 is switched to connect the oil separator 8 to the second heat exchanger 6 and connect the first heat exchanger 4 to the accumulator 7. In addition, during cooling operation, the refrigerant flow path switching device 3 is switched to connect the oil separator 8 to the first heat exchanger 4 and connect the second heat exchanger 6 to the accumulator 7.

Each of the first heat exchanger 4 and the second heat exchanger 6 may be composed of, for example, a fin-tube heat exchanger including a plurality of plate-like fins arranged in parallel and a heat-transfer pipe connected to the fins. The first heat exchanger 4 is connected at one side thereof to the refrigerant flow path switching device 3 and is connected at another side thereof to the expansion device 5. The second heat exchanger 6 is connected at one side thereof to the refrigerant flow path switching device 3 and is connected at another side thereof to the expansion device 5.

The expansion device 5 has a mechanism to reduce the pressure of the refrigerant, and may be composed of, for example, an expansion valve, a capillary tube, or the like. The expansion device 5 is connected at one side thereof to the first heat exchanger 4 and is connected at another side thereof to the second heat exchanger 6.

The accumulator 7 serves to store refrigerant liquid flowing thereinto from the refrigeration cycle apparatus 100 and inhibit refrigerant liquid from being excessively supplied to the compressor 1. The accumulator 7 is connected at a refrigerant inflow side to the first heat exchanger 4 or the second heat exchanger 6 via the refrigerant flow path switching device 3 and is connected at a refrigerant outflow side thereof to the refrigerant suction side of the compressor 1.

The oil separator 8 may be composed of, for example, a cyclone type oil separator. The refrigerant discharged from the compressor 1 is separated from the refrigerating machine oil by the oil separator 8, mainly flows to the refrigerant main pipe line 2, and partially flows to the oil return portion S1. In addition, the refrigerating machine oil discharged from the compressor 1 and separated from the refrigerant by the oil separator 8 flows to the oil return portion S1. The oil separator 8 is connected at a refrigerant/refrigerating machine oil inflow side thereof to the discharge side of the compressor 1, is connected at a refrigerant outflow side thereof to the refrigerant flow path switching device 3, and is connected at an oil outflow side thereof to the oil return portion S1 described later.

The refrigeration cycle apparatus 100 has the oil return portion S1 including: a flow control device 10 that adjusts the flow rate of the refrigerating machine oil; an oil reservoir portion 12 that stores the refrigerating machine oil; a first opening and closing device 14; and a first connection pipe 9, a second connection pipe 11, and a third connection pipe 13 that connect these components. The oil return portion S1 is connected to the oil separator 8, which is provided at the refrigerant discharge side of the compressor 1, the suction side of the compressor 1, and the outflow side of the accumulator 7.

In the oil return portion S1 of the refrigeration cycle apparatus 100 according to Embodiment 1, the oil outflow side of the oil separator 8 is connected to one end of the flow control device 10 via the first connection pipe 9. In addition, in the oil return portion S1, the first connection pipe 9 is connected to one end of the first opening and closing device 14 via the third connection pipe 13 branched from the first connection pipe 9. Moreover, in the oil return portion S1, the other end of the flow control device 10 is connected to the suction side of the compressor 1 and the outflow side of the accumulator 7 via the second connection pipe 11. In the oil return portion S1, the upper end of the oil reservoir portion 12 is connected to so as to branch downward from the second connection pipe 11. In the oil return portion S1, the other end of the first opening and closing device 14 is connected to the lower end of the oil reservoir portion 12.

The flow control device 10 serves to adjust the flow path resistance thereof to increase the flow path resistance such that a large amount of refrigerant gas is prevented from flowing to decrease the refrigeration cycle efficiency, during continuous operation. The flow control device 10 also serves to adjust the flow path resistance thereof to decrease the flow path resistance such that part of refrigerant gas also flows, to assuredly return the refrigerating machine oil separated by the oil separator 8 into the compressor 1. As described above, the flow control device 10 has the effect to reduce pressure from upstream to downstream, and may be composed of, for example, a capillary tube.

The oil reservoir portion 12 of the refrigeration cycle apparatus 100 according to Embodiment 1 includes an oil reservoir pipe 12A that stores the refrigerating machine oil, and a fourth connection pipe 15 that connects the oil reservoir pipe 12A to the first opening and closing device 14.

The oil reservoir pipe 12A is connected at an upper end thereof to a lower portion of the second connection pipe 11 and is connected at a lower end thereof to the fourth connection pipe 15. The oil reservoir pipe 12A is a pipe-shaped member and serves to store the refrigerating machine oil. The oil reservoir pipe 12A may have an inner diameter that is set to be large such that the refrigerating machine oil flows downward therein due to gravity in a state of no pressure difference from the upper end to the lower end; and the action of the surface tension becomes weaker as the refrigerant gas flows toward the second connection pipe 11 side.

The oil reservoir pipe 12A may have an inner diameter that is set to be small such that, at the time of start, in a state where the first opening and closing device 14 is opened, the flow speed of the refrigerant gas increases as the refrigerating machine oil flows together with the refrigerant gas from the lower end toward the upper end of the oil reservoir pipe 12A against gravity due to the pressure difference from the lower end to the upper end of the oil reservoir pipe 12A.

Figure 1B:
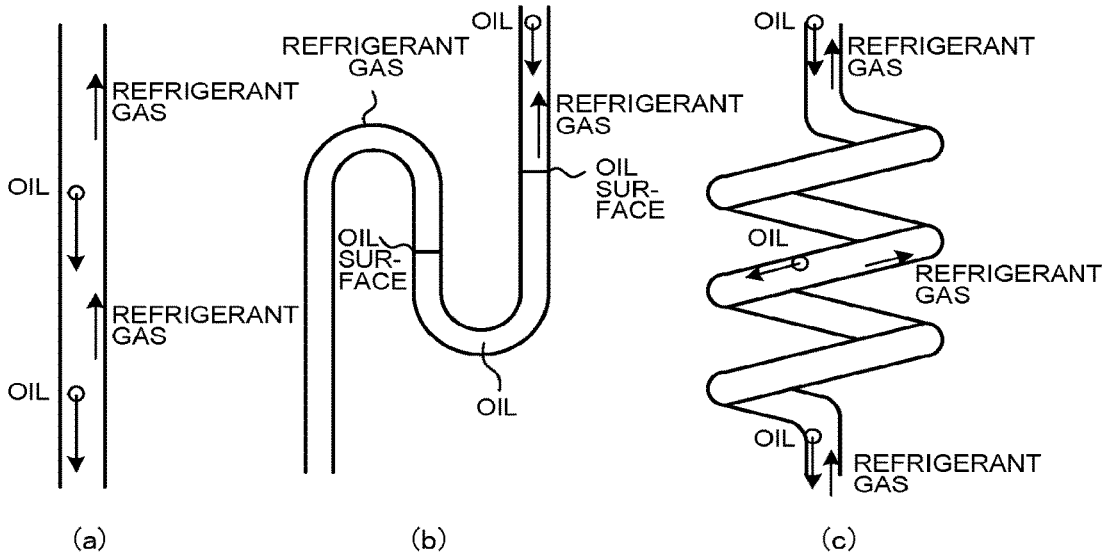
FIG. 1B is a schematic diagram showing configuration examples of an oil reservoir pipe 12A of the refrigeration cycle apparatus 100 according to Embodiment 1 of the present invention.

The oil reservoir pipe 12A does not use a configuration that is formed in a U shape by bending as shown in FIG. 1B(b). In the pipe line in the oil reservoir pipe 12A, the refrigerating machine oil flows during continuous operation due to the action of gravity, not due to pressure difference. Thus, with the configuration shown in FIG. 1B(b), the refrigerating machine oil becomes stuck in some cases. To avoid this, the oil reservoir pipe 12A is formed so as to extend from the lower side to the upper side over the range from the lower end, at which the oil reservoir pipe 12A is connected to the fourth connection pipe 15, to the upper end, at which the oil reservoir pipe 12A is connected to the lower portion of the second connection pipe 11. The oil reservoir pipe 12A may be formed in a straight shape as shown in FIG. 1B(a), or may be formed such that a curved portion is formed, for example, by meandering as shown in FIG. 1B(c).

The first opening and closing device 14 has an internal flow path structure that is adjusted such that when the first opening and closing device 14 is opened, the flow path resistance thereof is lower than the flow path resistance of the flow control device 10. The first opening and closing device 14 may be composed of, for example, a solenoid valve. The first opening and closing device 14 of the refrigeration cycle apparatus 100 according to Embodiment 1 is opened when the compressor 1 is started, and is closed during continuous operation.

The first connection pipe 9 has a pipe diameter that is adjusted such that the flow path resistance thereof is lower than the flow path resistance of the flow control device 10. The first connection pipe 9 is connected to the oil outflow side of the oil separator 8 and the one end of the flow control device 10 and is connected to the third connection pipe 13 so as to branch in the middle thereof.

The second connection pipe 11 has a pipe diameter that is adjusted such that the flow path resistance thereof is lower than the flow path resistance of the flow control device 10. The second connection pipe 11 is connected to the other end of the flow control device 10, the suction side of the compressor 1, and the outflow side of the accumulator 7. The second connection pipe 11 is connected to the upper end of the oil reservoir pipe 12A of the oil reservoir portion 12 so as to branch between: the other end of the flow control device 10; and the suction side of the compressor 1 and the outflow side of the accumulator 7.

The connection portion between the second connection pipe 11 and the upper end of the oil reservoir pipe 12A is formed at the lower portion of the second connection pipe 11 such that the second connection pipe 11 is located at the upper side, the oil reservoir pipe 12A is located at the lower side, and part of the refrigerating machine oil flowing through the second connection pipe 11 during continuous operation flows down into the oil reservoir pipe 12A due to gravity.

The third connection pipe 13 has a pipe diameter that is adjusted such that the flow path resistance thereof is lower than the flow path resistance of the flow control device 10. The third connection pipe 13 is connected to the first connection pipe 9 and the one end of the first opening and closing device 14 so as to branch from the first connection pipe 9.

The refrigeration cycle apparatus 100 includes a controller 25 that opens the first opening and closing device 14 when the compressor 1 is started. The controller 25 is composed of, for example, a microcomputer, and executes control of a rotation speed, including operation and stop, of the compressor 1, control of the opening degree of the expansion device 5, control of switching of the refrigerant flow path switching device 3, and opening and closing control of the first opening and closing device 14. In addition, the controller 25 has, for example, a clocking function, and is configured to be able to operate the compressor 1 or control opening/closing of the first opening and closing device 14 at preset timing.

[Timing of Start of Compressor 1]

Figure 1C:
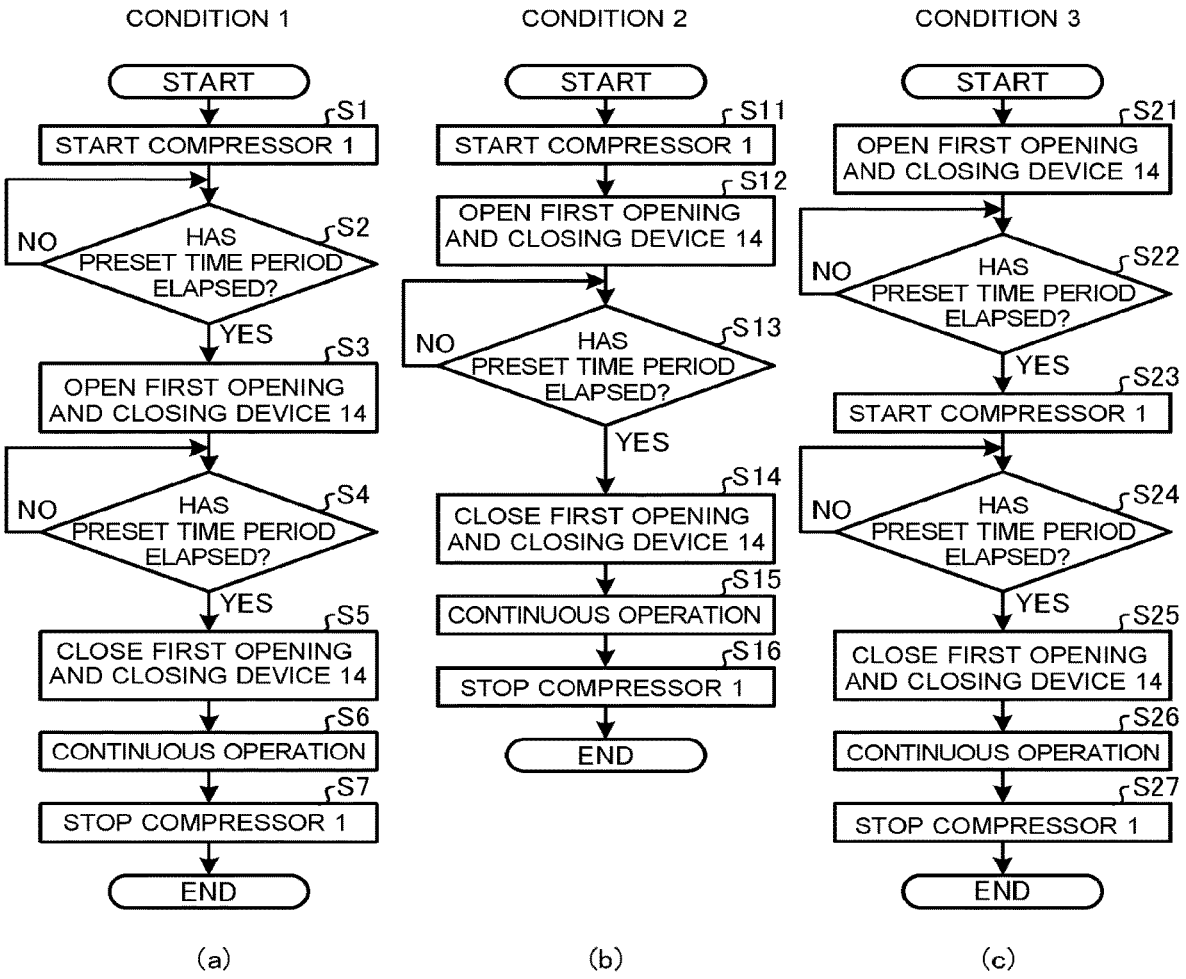
FIG. 1C is a flowchart showing an example of control of the refrigeration cycle apparatus 100 according to Embodiment 1 of the present invention.

FIG. 1C is a flowchart showing an example of control of the refrigeration cycle apparatus 100 according to Embodiment 1 of the present invention. As shown in FIG. 1C, control of the refrigeration cycle apparatus 100 has three conditions for the case of starting the compressor 1. FIG. 1C(a) shows Condition 1, FIG. 1C(b) shows Condition 2, and FIG. 1C(c) shows Condition 3.

First, a control flowchart according to Condition 1 will be described with reference to FIG. 1C(a).

The controller 25 starts the compressor 1 (step S1). The controller 25 determines whether a preset time period has elapsed (step S2). When the controller 25 determines that the preset time period has elapsed, the controller 25 shifts to (step S3). When the controller 25 determines that the preset time period has not elapsed, the controller 25 repeats (step S2).

The controller 25 opens the first opening and closing device 14 (step S3). The controller 25 determines whether a preset time period has elapsed (step S4). When the controller 25 determines that the preset time period has elapsed, the controller 25 shifts to (step S5). When the controller 25 determines that the preset time period has not elapsed, the controller 25 repeats (step S4). The controller 25 closes the first opening and closing device 14 (step S5). The controller 25 executes later-described continuous operation (step S6). The controller 25 stops the compressor 1 (step S7).

As described above, in the control according to Condition 1, the compressor 1 is started, and the first opening and closing device 14 is opened after the preset time period has elapsed. This considers the fact that, immediately after the compressor 1 is started, foaming of the refrigerating machine oil easily occur due to vaporization of the refrigerant within the compressor 1, and the refrigerating machine oil easily flows out.

Next, a control flowchart according to Condition 2 will be described with reference to FIG. 1C(b).

The controller 25 starts the compressor 1 (step S11). The controller 25 opens the first opening and closing device 14 (step S12). The controller 25 determines whether a preset time period has elapsed (step S13). When the controller 25 determines that the preset time period has elapsed, the controller 25 shifts to (step S14). When the controller 25 determines that the preset time period has not elapsed, the controller 25 repeats (step S13).

The controller 25 closes the first opening and closing device 14 (step S14). The controller 25 executes continuous operation (step S15). The controller 25 stops the compressor 1 (step S16).

As described above, in the control according to Condition 2, after the compressor 1 is started, the first opening and closing device 14 is opened before the preset time period has elapsed. In a state where the refrigerating machine oil has run out in the compressor 1, the amount of the refrigerating machine oil flowing out from the inside of the compressor 1 is small. Thus, in Condition 2, in a state where the refrigerating machine oil has run out, immediately after the compressor 1 is started, the first opening and closing device 14 is intentionally opened for lubricating the compressor 1.

Furthermore, a control flowchart according to Condition 3 will be described with reference to FIG. 1C(c).

The controller 25 opens the first opening and closing device 14 (step S21). The controller 25 determines whether a preset time period has elapsed (step S22). When the controller 25 determines that the preset time period has elapsed, the controller 25 shifts to (step S23). When the controller 25 determines that the preset time period has not elapsed, the controller 25 repeats (step S22).

The controller 25 starts the compressor 1 (step S23). The controller 25 determines whether a preset time period has elapsed (step S24). When the controller 25 determines that the preset time period has elapsed, the controller 25 shifts to (step S25). When the controller 25 determines that the preset time period has not elapsed, the controller 25 repeats (step S24). The controller 25 closes the first opening and closing device 14 (step S25). The controller 25 executes later-described continuous operation (step S26). The controller 25 stops the compressor 1 (step S27).

As described above, in the control according to Condition 3, the order of the timing for starting the compressor 1 and the timing for opening the first opening and closing device 14 is opposite to that in Condition 1 and Condition 2. Undoubtedly, unless the compressor 1 is started, the refrigerant does not circulate, and thus it is difficult to return also the refrigerating machine oil to the compressor 1. However, in reality, even when the compressor 1 has stopped, residual pressure occurs in the refrigerant circuit. Thus, pressure that makes the refrigerating machine oil return to the compressor 1 may be applied to the refrigerating machine oil. Thus, in Condition 3, before the compressor 1 is started, the first opening and closing device 14 is intentionally opened for lubricating the compressor 1.

The controller 25 opens the first opening and closing device 14 when the compressor 1 is started. Here, regarding a temporal condition for the case of starting the compressor 1, Conditions 1 to 3 will be separately described below.

[Condition 1]

As shown in FIG. 1C(a), the controller 25 starts the compressor 1, and opens the first opening and closing device 14 after a preset time period has elapsed. The preset time period is set to a time period to be taken until foaming of the oil surface due to vaporization of the refrigerant within the compressor 1 ceases (see step S2). Immediately after the compressor 1 is started, the liquid refrigerant within the compressor 1 vaporizes to foam the oil surface, and the amount of the refrigerating machine oil discharged becomes very large. Thus, in a state where the oil surface is foamed, even when the refrigerating machine oil is returned to the compressor 1, there is a possibility that the refrigerating machine oil immediately comes out of the compressor 1. In addition, since the refrigerating machine oil has a lower specific gravity than the liquid refrigerant, high oil concentration portions are likely to gather above the liquid surface (the foaming side) within the compressor 1, and thus the refrigerating machine oil flows out of the compressor 1 even when the refrigerating machine oil is returned to the compressor 1 immediately after the compressor 1 is started. Therefore, the controller 25 opens the first opening and closing device 14 after the preset time period has elapsed. Accordingly, it is possible to inhibit the returned refrigerating machine oil from flowing out from the compressor 1.

[Condition 2]

As shown in FIG. 1C(b), the controller 25 opens the first opening and closing device 14 immediately after the compressor 1 is started, that is, with start of the compressor 1.

In some case, the refrigerating machine oil has run out in the compressor 1, and thus the dense refrigerating machine oil is desired to be returned to the compressor 1 as early as possible for lubricating a compression mechanism portion. Therefore, the controller 25 may start the first opening and closing device 14 with start of the compressor 1. For example, Condition 2 may be used in a situation in which the refrigerating machine oil does not flow out from the compressor 1 as described for Condition 1.

[Condition 3]

As shown in FIG. 1C(c), the controller 25 starts the compressor 1 after a preset time period has elapsed from the time when the first opening and closing device 14 is opened.

In some case, the refrigerating machine oil required within the compressor 1 at the time of start of the compressor 1 is insufficient, and the dense refrigerating machine oil is desired to be returned to the compressor 1 for lubricating the compression mechanism portion, before start of the compressor 1. Therefore, the controller 25 may start the first opening and closing device 14 before the compressor 1 is started. For example, even when the compressor 1 has stopped, residue pressure at the discharge side of the compressor 1, within the oil separator 8, and the like is higher than residue pressure at the suction side of the compressor 1 in some cases. In such a case, Condition 3 may be used if the refrigeration cycle apparatus 100 is an apparatus in which, in the oil reservoir pipe 12A, the flow rate of the refrigerant gas increases as the refrigerating machine oil moves up from the lower end toward the upper end together with the refrigerant gas against gravity, and it is possible to return the oil from the oil reservoir portion 12 via the second connection pipe 11 to the inside of the compressor 1.

[Description of Operation of Refrigeration Cycle Apparatus 100]

Next, operation of the refrigeration cycle apparatus 100 will be described. Here, the case where the controller 25 operates under Condition 1 shown in FIG. 1C(a) will be described as an example. That is, an operation in which the first opening and closing device 14 is not opened with start of the compressor 1, and the first opening and closing device 14 is opened after a preset time period has elapsed, will be described.

As shown in FIG. 1C(a), the controller 25 starts the compressor 1, and opens the first opening and closing device 14 for a preset time period after a preset time period has elapsed.

Here, the reason why the compressor 1 is started, and the first opening and closing device 14 is opened after the preset time period has elapsed, is that immediately after the compressor 1 is started, the liquid refrigerant within the compressor 1 may vaporize to foam the oil surface, so that the refrigerating machine oil immediately flows out of the compressor 1 even when the refrigerating machine oil is returned to the compressor 1. Therefore, the timing for opening the first opening and closing device 14 is delayed from the timing for starting the compressor 1 by a time period to be taken until foaming due to the vaporization of the liquid refrigerant within the compressor 1 ceases.

The reason why the first opening and closing device 14 is opened for the preset time period is to return the refrigerating machine oil stored in the oil reservoir portion 12 to the compressor 1.

The reason why the first opening and closing device 14 is opened for the preset time period and then closed is to store the refrigerating machine oil in the oil reservoir portion 12 again, and to prevent a large amount of the refrigerant from flowing to the oil reservoir portion 12 to decrease the amount of the refrigerant flowing through the refrigerant main pipe line 2, resulting in deterioration of performance of the refrigeration cycle apparatus 100.

During continuous operation and during stop, the controller 25 closes the first opening and closing device 14. Here, "during continuous operation" does not refer to immediately after the compressor 1 is started, but refers to the time when a preset time period has elapsed and operation of the compressor 1 becomes stabilized after the compressor 1 is started.

During continuous operation of the compressor 1, the refrigerating machine oil within the compressor 1 is discharged together with the refrigerant gas, is separated in the oil separator 8, and is returned to the inside of the compressor 1 through the first connection pipe 9, the flow control device 10, the second connection pipe 11, and the pipe at the suction side of the compressor 1 in this order. Accordingly, the refrigerating machine oil within the compressor 1 is inhibited from running out.

The degree of throttling of the flow control device 10 is adjusted such that, under all operation conditions assumed in the refrigeration cycle apparatus 100, the amount of the oil flowing per unit time is not less than the amount of the oil separated in the oil separator 8 per unit time. Specifically, the degree of throttling of the flow control device 10 is adjusted such that the oil separated within the oil separator 8 does not overflow. The aforementioned operation conditions exclude the time of change of the rotation speed of the compressor 1 including the time of start.

Not only the refrigerating machine oil but also part of the refrigerant gas flows through the first connection pipe 9, the flow control device 10, and the second connection pipe 11 of the oil return portion S1. In addition, part of the oil separated in the oil separator 8 enters the oil reservoir pipe 12A of the oil reservoir portion 12 from the second connection pipe 11 due to gravity drop, and the oil accumulates until the oil surface reaches the joint portion between the oil reservoir pipe 12A and the second connection pipe 11. Thereafter, the oil no longer accumulates within the oil reservoir portion 12, and the amount of the oil separated in the oil separator 8 and the amount of the oil flowing through the flow control device 10 become equal to each other.

Even when the compressor 1 is stopped in this state, the oil is kept accumulated within the oil reservoir portion 12. Thereafter, when the first opening and closing device 14 is opened when the compressor 1 is started, the oil within the oil reservoir portion 12 flows from the second connection pipe 11 through the pipe at the suction side of the compressor 1 into the compressor 1 due to the pressure difference between the discharge side and the suction side of the compressor 1.

[Advantageous Effects of Refrigeration Cycle Apparatus 100 According to Embodiment 1]

In the refrigeration cycle apparatus 100 according to Embodiment 1, it is possible to close the first opening and closing device 14 upstream of the oil reservoir portion 12 during continuous operation to store the refrigerating machine oil within the oil reservoir portion 12 and to open the first opening and closing device 14 at the time of start to return the stored refrigerating machine oil to the inside of the compressor 1. Accordingly, it is possible to inhibit the refrigerating machine oil in the compressor 1 from running out when the compressor 1 is started, and to inhibit the concentration of the refrigerating machine oil within the compressor 1 from decreasing to cause poor lubrication of the compression mechanism portion.

In the refrigeration cycle apparatus 100 according to Embodiment 1, even when a large amount of the refrigerating machine oil is discharged from the compressor 1 due to foaming caused by rapid vaporization, at the time of start of the compressor 1, of the liquid refrigerant that is accumulated while being present together with the refrigerating machine oil during stop of the compressor 1, the refrigerating machine oil is immediately supplied through the suction side of the compressor 1, and thus it is possible to inhibit poor lubrication of the compression mechanism portion due to run-out of the refrigerating machine oil.

During stop of the compressor 1, when a large amount of the liquid refrigerant accumulates within the compressor 1, even if foaming due to vaporization of the refrigerant is inhibited at the time of start, the compressor 1 continuously operates in a state where the concentration of the refrigerating machine oil is low, for a while until the refrigerant vaporizes. Thus, poor lubrication of the compression mechanism portion of the compressor 1 is likely to occur. However, in the refrigeration cycle apparatus 100 according to Embodiment 1, when the compressor 1 is started, the high-concentration refrigerating machine oil flows into the compressor 1, and thus it is possible to inhibit poor lubrication of the compression mechanism portion.

In the refrigeration cycle apparatus 100 according to Embodiment 1, it is possible to inhibit poor lubrication of even the compressor 1 in which the amount of the oil retained is small, so that it is possible to reduce the size of the compressor 1. When the amount of the initially filled refrigerating machine oil is increased to prevent poor lubrication at the time of start of the compressor 1, a state where the refrigerating machine oil is excessively accumulated within the compressor during continuous operation is obtained, the motor (rotor) of the compressor 1 is also immersed in the refrigerating machine oil, so that compression efficiency decreases. However, the refrigeration cycle apparatus 100 according to Embodiment 1 uses the configuration in which excess oil is retained outside the compressor 1 during continuous operation. That is, during continuous operation, the first opening and closing device 14 is closed, and thus the refrigerating machine oil is stored within the oil reservoir portion 12. Therefore, it is possible to inhibit the amount of the oil within the compressor 1 from becoming excessively large, resulting in deterioration of performance such as compression efficiency.

The refrigeration cycle apparatus 100 according to Embodiment 1 uses the configuration in which excess oil is retained outside the compressor 1 during continuous operation. Thus, the oil surface within the compressor 1 becomes higher during continuous operation. Accordingly, the amount of the discharged refrigerating machine oil increases, and the refrigerating machine oil is transferred to the first heat exchanger 4 and the like, so that it is possible to inhibit reduction in heat exchange efficiency.

In the refrigeration cycle apparatus 100 according to the Embodiment 1, the low-pressure refrigerating machine oil accumulates within the oil reservoir portion 12, and thus the refrigerant is less likely to accumulate in the oil reservoir portion 12. When the refrigerant in the refrigeration cycle is made into low temperature and high pressure, the refrigerant is easily liquefied and easily dissolved into the refrigerating machine oil. For example, when the refrigerating machine oil flowing through the first connection pipe 9 is accumulated, the refrigerating machine oil has not flowed through the flow control device 10 and is made into high pressure. In addition, almost no flow occurs in the oil reservoir portion 12, so that heat transfers through the wall surface to the outdoor air and the refrigerating machine oil is made into low temperature. Thus, in such a refrigeration cycle apparatus 100, the oil reservoir portion 12 is made into low temperature and high pressure, the refrigerant accumulates therein, and the amount of the refrigerating machine oil stored therein decreases, so that it is necessary to increase the size of the oil reservoir portion 12 to ensure a required amount of the refrigerating machine oil, and the amount of the refrigerant within the refrigeration cycle apparatus 100 also increases. Therefore, in the refrigeration cycle apparatus 100 according to Embodiment 1, since the refrigerating machine oil that has passed through the flow control device 10 to have low pressure accumulates within the oil reservoir portion 12, the refrigerant is less likely to accumulate in the oil reservoir portion 12. Accordingly, even when the configuration in which the required amount of the refrigerating machine oil is supplied into the compressor 1 when the compressor 1 is stated is used, a squeeze is not put on the capacity of the refrigeration cycle apparatus 100, and it is possible to inhibit an increase in the refrigerant amount.

The refrigeration cycle apparatus 100 according to Embodiment 1 uses the configuration in which it is possible to accumulate a substantially constant amount of the refrigerating machine oil within the oil reservoir portion 12. As the configuration for accumulating the refrigerating machine oil during continuous operation, for example, a configuration in which the inner diameter of the second connection pipe 11 is increased for accumulating the refrigerating machine oil within the second connection pipe 11 using gravity is also conceivable. However, in this configuration, the refrigerating machine oil and the refrigerant gas constantly flow into and out from the second connection pipe 11 during continuous operation. Thus, when the operating conditions of the refrigeration cycle apparatus 100 change and the proportion of the refrigerant gas increases, the capacity is taken by air bubbles of the refrigerant gas, and the amount of the refrigerating machine oil to be accumulated within the second connection pipe 11 changes. In the refrigeration cycle apparatus 100 according to Embodiment 1, even when the ratio of the amounts of the refrigerant gas and the refrigerating machine oil flowing through the second connection pipe 11 changes during continuous operation, the amount of the refrigerating machine oil to be accumulated in the oil reservoir portion 12 does not change, so that it is possible to inhibit the amount of the refrigerating machine oil within the compressor 1 from becoming excessively large to decrease the performance such as compression efficiency.

For the refrigerant main pipe line 2, there are various configurations according to the purpose of use of the refrigeration cycle apparatus 100, but it is possible to obtain the same advantageous effects as in the refrigeration cycle apparatus 100 according to Embodiment 1 even when the refrigerant main pipe line 2 is not limited to the form in Embodiment 1.

The accumulator 7 is connected between the refrigerant main pipe line 2 and the suction side of the compressor 1. Even when the accumulator 7 is not provided, it is possible to obtain the same advantageous effects as in the refrigeration cycle apparatus 100 according to Embodiment 1.

The case where the flow control device 10 is a capillary tube has been described as an example in Embodiment 1, but the present invention is not limited thereto. Even when the flow control device 10 is composed of, for example, a flow control valve capable of changing its opening degree, it is possible to obtain the same advantageous effects as in the refrigeration cycle apparatus 100 according to Embodiment 1. In the case where a flow control valve is used, while the oil is accumulated within the oil reservoir portion 12 during continuous operation, the opening degree may be adjusted such that at least part of the refrigerant gas also flows together with the oil through the first connection pipe 9, the flow control device 10, and the second connection pipe 11.

Each of the first heat exchanger 4 and the second heat exchanger 6 is not limited to be composed of a single heat exchanger. Even when each of the first heat exchanger 4 and the second heat exchanger 6 uses, for example, a configuration in which a plurality of heat exchangers are connected in parallel, a configuration in which a plurality of heat exchangers are connected in series, or a configuration in which parallel connection and series connection of heat exchangers are combined, it is possible to obtain the same advantageous effects as in the refrigeration cycle apparatus 100 according to Embodiment 1.

Although not shown in FIG. 1A, the refrigeration cycle apparatus 100 may use a mode in which a gas-liquid separator and a bypass pipe are provided, or may use a mode in which an opening/closing valve and a flow control valve are provided on each pipe, for example. In addition, the refrigeration cycle apparatus 100 may have a mode in which the refrigerant flow path switching device 3 is not provided. Even with these modes, it is possible to obtain the same advantageous effects as in the refrigeration cycle apparatus 100 according to Embodiment 1.

[Modification 1 of Embodiment 1]

Figure 1D:
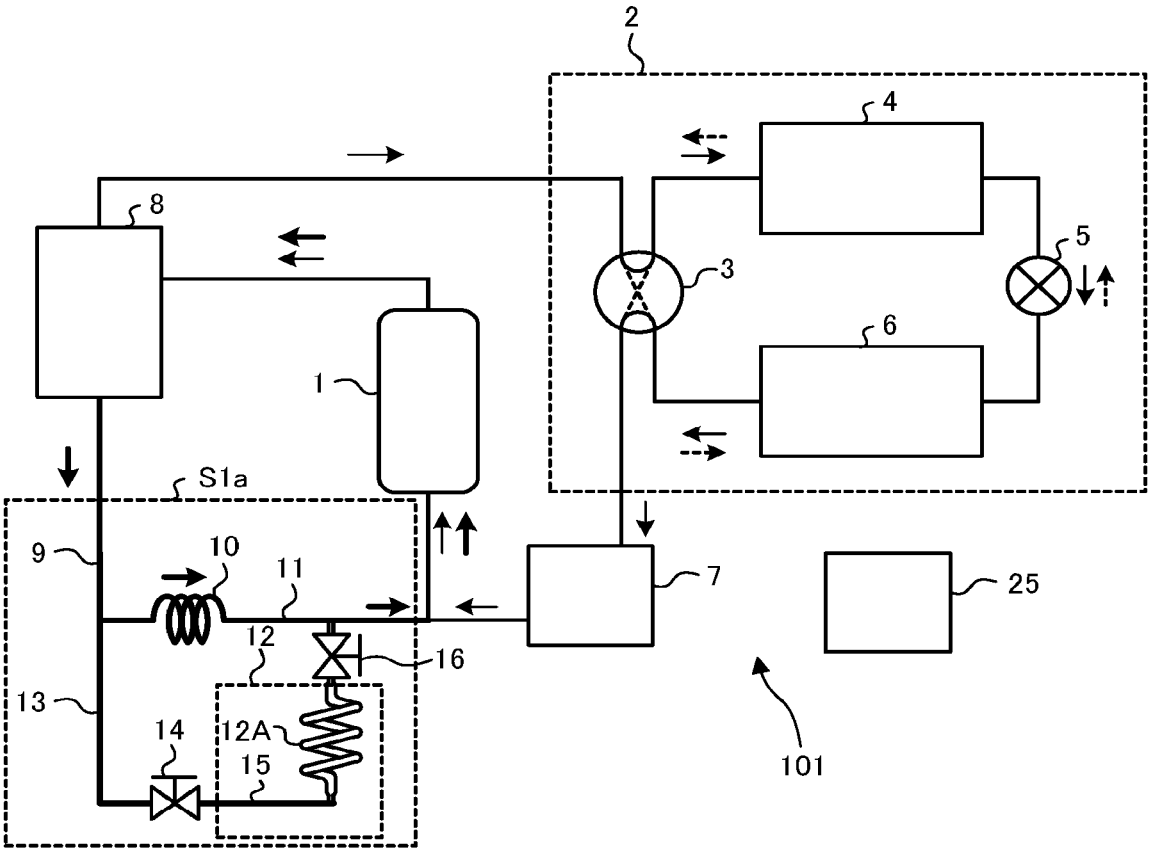
FIG. 1D is a schematic configuration showing Modification 1 of the refrigeration cycle apparatus 100 according to Embodiment 1 of the present invention.

FIG. 1D is a schematic configuration diagram showing Modification 1 of the refrigeration cycle apparatus 100 according to Embodiment 1 of the present invention. Components having the same functions and operations as in Embodiment 1 are designated by the same reference signs, and the description thereof is omitted. As shown in FIG. 1D, the refrigeration cycle apparatus 101 includes a second opening and closing device 16 above the oil reservoir pipe 12A that is provided in an oil return portion S1*a*. The second opening and closing device 16 may be composed of, for example, a solenoid valve.

Figure 1E:
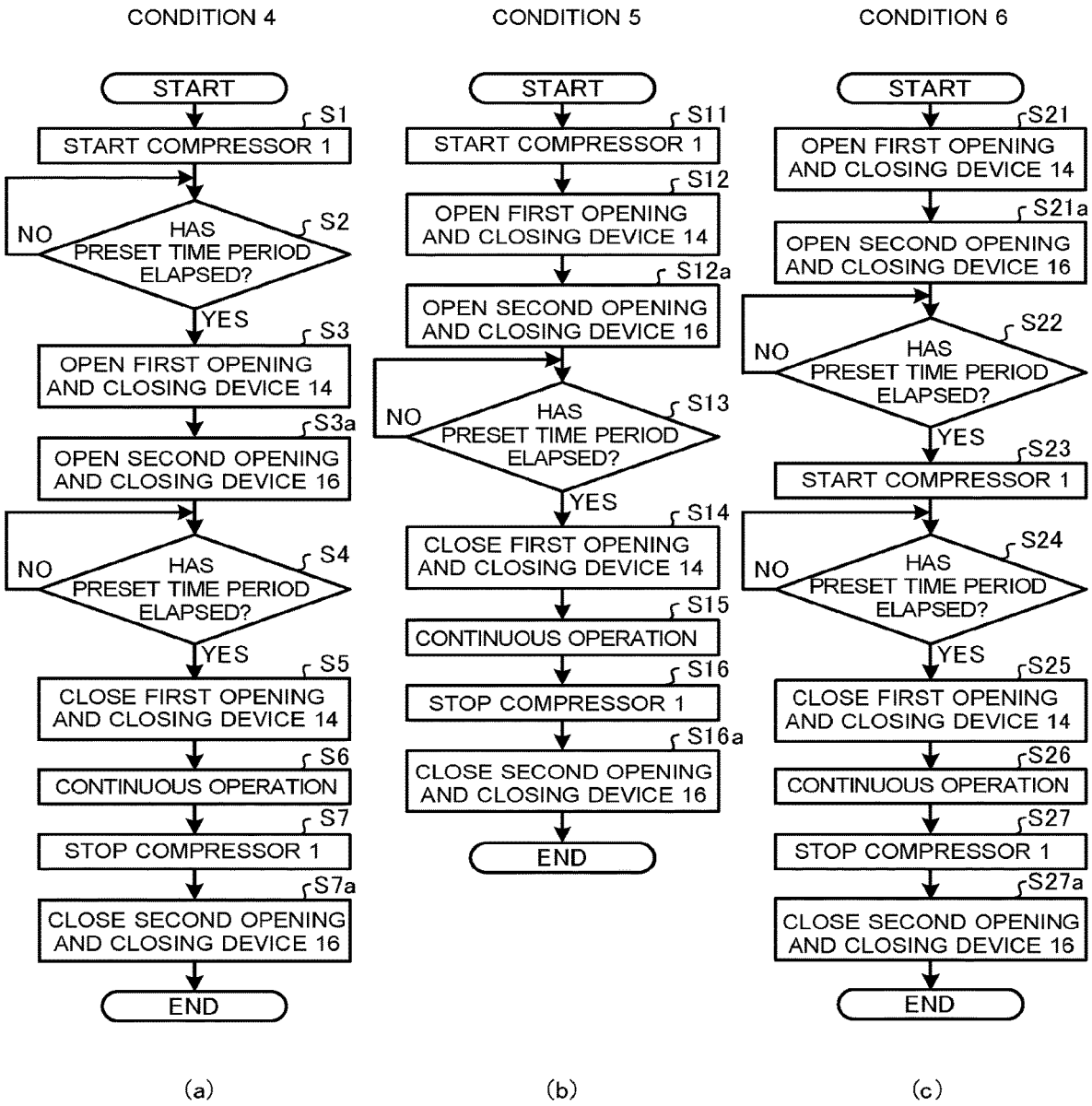
FIG. 1E is a flowchart showing an example of control of a refrigeration cycle apparatus 101 according to Embodiment 1 of the present invention.

FIG. 1E is a flowchart showing an example of control of the refrigeration cycle apparatus 101 according to Embodiment 1 of the present invention. With reference to FIG. 1E, operation of the refrigeration cycle apparatus 101 according to Modification 1 of Embodiment 1 will be described. The refrigeration cycle apparatus 101 also executes control according to Condition 4 (FIG. 1E(a)) corresponding to Condition 1 (FIG. 1C(a)) for control of the refrigeration cycle apparatus 100, Condition 5 (FIG. 1E(b)) corresponding to Condition 2 (FIG. 1C(b)), and Condition 6 (FIG. 1E(c)) corresponding to Condition 3 (FIG. 1C(c)).

The difference between FIG. 1C(a) to FIG. 1C(c) and FIG. 1E(a) to FIG. 1E(c) is as follows. FIG. 1E is different from FIG. 1C in that a step of opening and closing control of the second opening and closing device 16 is added to each condition in the control flowchart for the refrigeration cycle apparatus 101 as shown in FIG. 1E. Specifically, in FIG. 1E(a), a step (step S3*a*) of opening the second opening and closing device 16 and a step (step S7*a*) of closing the second opening and closing device 16 are added. The other is the same as in FIG. 1C(a). In addition, also in FIG. 1E(b), (step S12*a*) and (step S16*a*) are added, and the other is the same as in FIG. 1C(b). Moreover, also in FIG. 1E(c), similarly, (step S21*a*) and (step S27*a*) are added, and the other is the same as in FIG. 1C(c).

As shown in FIG. 1E, the first opening and closing device 14 operates in the same manner as in Embodiment 1. In Condition 4 shown in FIG. 1E(a) of Modification 1 including the second opening and closing device 16, similar to the case shown in Condition 1 in FIG. 1C(a) of Embodiment 1, the controller 25 opens the first opening and closing device 14 and the second opening and closing device 16 after a preset time period has elapsed immediately after start of the compressor 1.

In Condition 5 shown in FIG. 1E(b) of Modification 1 including the second opening and closing device 16, similar to the case shown in Condition 2 in FIG. 1C(b) of Embodiment 1, immediately after start of the compressor 1, that is, with start of the compressor 1, the first opening and closing device 14 and the second opening and closing device 16 are opened.

In Condition 6 shown in FIG. 1E(c) of Modification 1 including the second opening and closing device 16, similar to the case shown in Condition 3 in FIG. 1C(c) of Embodiment 1, the compressor 1 is started after a preset time period has elapsed immediately after the first opening and closing device 14 and the second opening and closing device 16 are opened.

The second opening and closing device 16 may be opened before the first opening and closing device 14 is opened. Accordingly, when the internal pressure of the oil reservoir portion 12 is higher than the internal pressure of the third connection pipe 13, it is possible to prevent the refrigerating machine oil from flowing back from the oil reservoir portion 12 via the first opening and closing device 14 to the third connection pipe 13.

The controller 25 opens the second opening and closing device 16 during continuous operation of the compressor 1.

More specifically, the controller 25 starts the compressor 1 and opens the first opening and closing device 14 and the second opening and closing device 16, and then closes the first opening and closing device 14.

Furthermore, the controller 25 closes the second opening and closing device 16 during stop of the compressor 1.

When the configuration of Modification 1 is used, during stop of the compressor 1, the interior of the oil reservoir portion 12 is closed, and the refrigerating machine oil is maintained at a high concentration with respect to the refrigerant. That is, at the time of start, it is possible to return the high-concentration refrigerating machine oil into the compressor 1 to increase the concentration of the refrigerating machine oil within the compressor 1. Therefore, in the refrigeration cycle apparatus 101 according to Modification 1, it is possible to more assuredly inhibit poor lubrication of the compressor 1.

During stop of the compressor 1, by closing the first opening and closing device 14 and the second opening and closing device 16, the oil reservoir portion 12 becomes a closed space. Thus, the amount of the refrigerant at the time when the first opening and closing device 14 and the second opening and closing device 16 are closed is maintained, and thus it is possible to obtain the effect that, in a low-pressure state, that is, in a low-concentration state during operation before the first opening and closing device 14 and the second opening and closing device 16 are closed, the amount of the refrigerant is small, so that the refrigerant is not dissolved into the refrigerating machine oil much.

In FIG. 1A of Embodiment 1, the pressure within the oil reservoir portion 12 becomes equal to that in a portion such as the other pipe as time passes. Meanwhile, in FIG. 1D, during stop of the compressor 1, the amount of the refrigerant within the oil reservoir portion 12 is small, and thus the ratio of the oil to the refrigerant is increased. Therefore, the pressure within the oil reservoir portion 12 becomes saturated dissolution pressure at the temperature after the time elapses. However, the sum of the amount (concentration) of the refrigerant dissolved in the refrigerating machine oil and the amount (pressure) of the refrigerant vaporized within the oil reservoir portion 12 is equilibrated to be equal to the amount of the refrigerant within the oil reservoir portion 12 at the time when the first opening and closing device 14 and the second opening and closing device 16 are closed to close the oil reservoir portion 12. Then, the pressure in the portion such as the other pipe becomes saturated vapor pressure.

[Modification 2 of Embodiment 1]

Figure 1F:
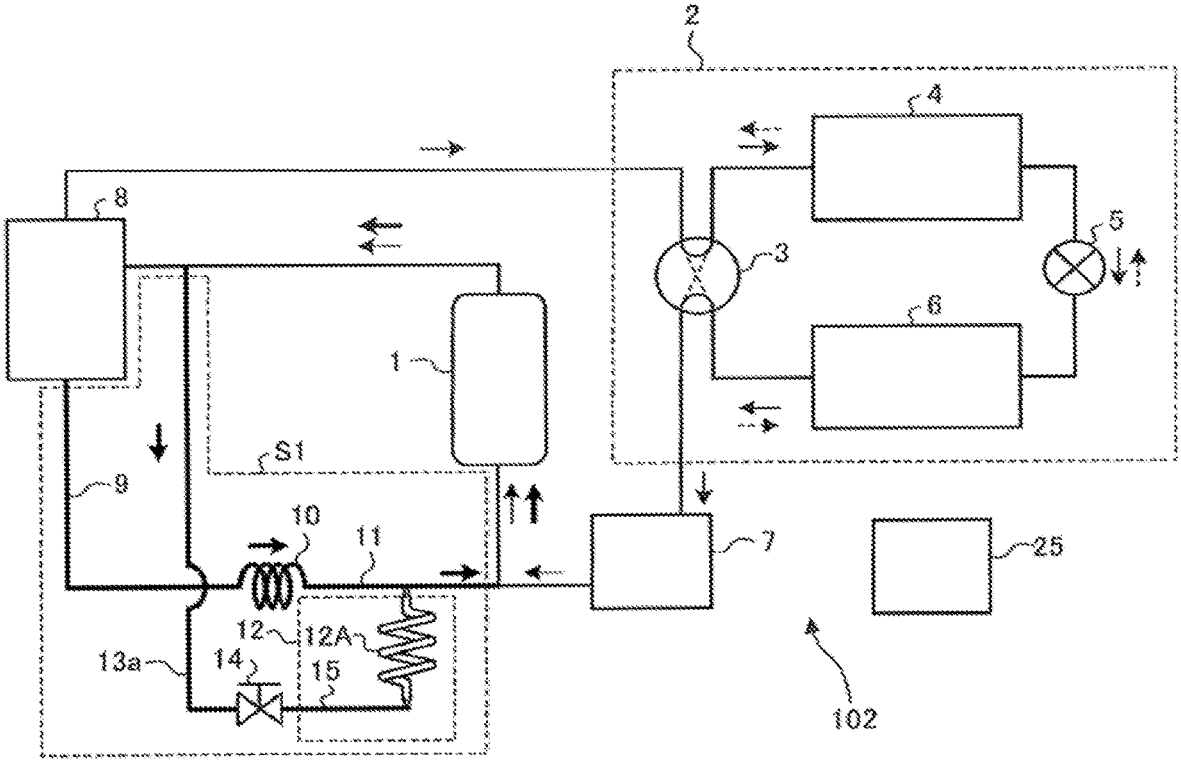
FIG. 1F is a schematic configuration diagram showing Modification 2 of the refrigeration cycle apparatus 100 according to Embodiment 1 of the present invention.

FIG. 1F is a schematic configuration diagram showing Modification 2 of the refrigeration cycle apparatus 100 according to Embodiment 1 of the present invention. Components having the same functions and operations as in Embodiment 1 are designated by the same reference signs, and the description thereof is omitted. As shown in FIG. 1F, a refrigeration cycle apparatus 102 includes, instead of the third connection pipe 13, a third connection pipe 13*a* that is connected at one end thereof so as to branch from a pipe connecting the refrigerant discharge side of the compressor 1 and the oil separator 8 and that is connected at another end thereof to the first opening and closing device 14. The refrigeration cycle apparatus 102 according to Modification 2 executes the same control as the control of the refrigeration cycle apparatus 100 according to Embodiment 1 shown in FIG. 1C.

When the configuration of Modification 2 is used, it is possible to obtain the same advantageous effects as in the refrigeration cycle apparatus 100 according to Embodiment 1, as a substitute for the case where it is not possible to use the connection configuration of the third connection pipe 13 due to the structural limitations on the refrigeration cycle apparatus 102.

In the case of executing control of Condition 2 in FIG. 1C(b) and Condition 3 in FIG. 1C(c), the refrigeration cycle apparatus 102 according to Modification 2 opens the first opening and closing device 14, and then part of the refrigerant and the oil discharged from the compressor 1 is returned through the third connection pipe 13*a* and the oil reservoir portion 12 to the compressor 1. Thus, the amounts of the refrigerant and the oil flowing into the oil separator 8 decrease. In the refrigeration cycle apparatus 100 according to Embodiment 1 or the refrigeration cycle apparatus 101 according to Modification 1, when the amount of the refrigerant and the oil flowing into the oil separator 8 is excessively large, the oil may scatter or accumulate within the oil separator 8, the oil separation efficiency may decrease, and the oil may flow to the refrigerant main pipe line 2. Therefore, the refrigeration cycle apparatus 102 according to Modification 2 is able to more assuredly inhibit poor lubrication of the compressor 1 in the case of executing control of Condition 2 and Condition 3.

The refrigeration cycle apparatus 102 according to Modification 2 of Embodiment 1 of the present invention is also applicable to the configuration of the refrigeration cycle apparatus 101 according to Modification 1 of Embodiment 1. In this case, the refrigeration cycle apparatus 102 includes, instead of the third connection pipe 13 of the refrigeration cycle apparatus 101 shown in FIG. 1D, the third connection pipe 13*a* that is connected at one end thereof so as to branch from the pipe connecting the refrigerant discharge side of the compressor 1 and the oil separator 8 and that is connected at another end thereof to the first opening and closing device 14, and executes the same control as the control of the refrigeration cycle apparatus 101 according to Embodiment 1 shown in FIG. 1E.

Embodiment 2

Figure 2A:
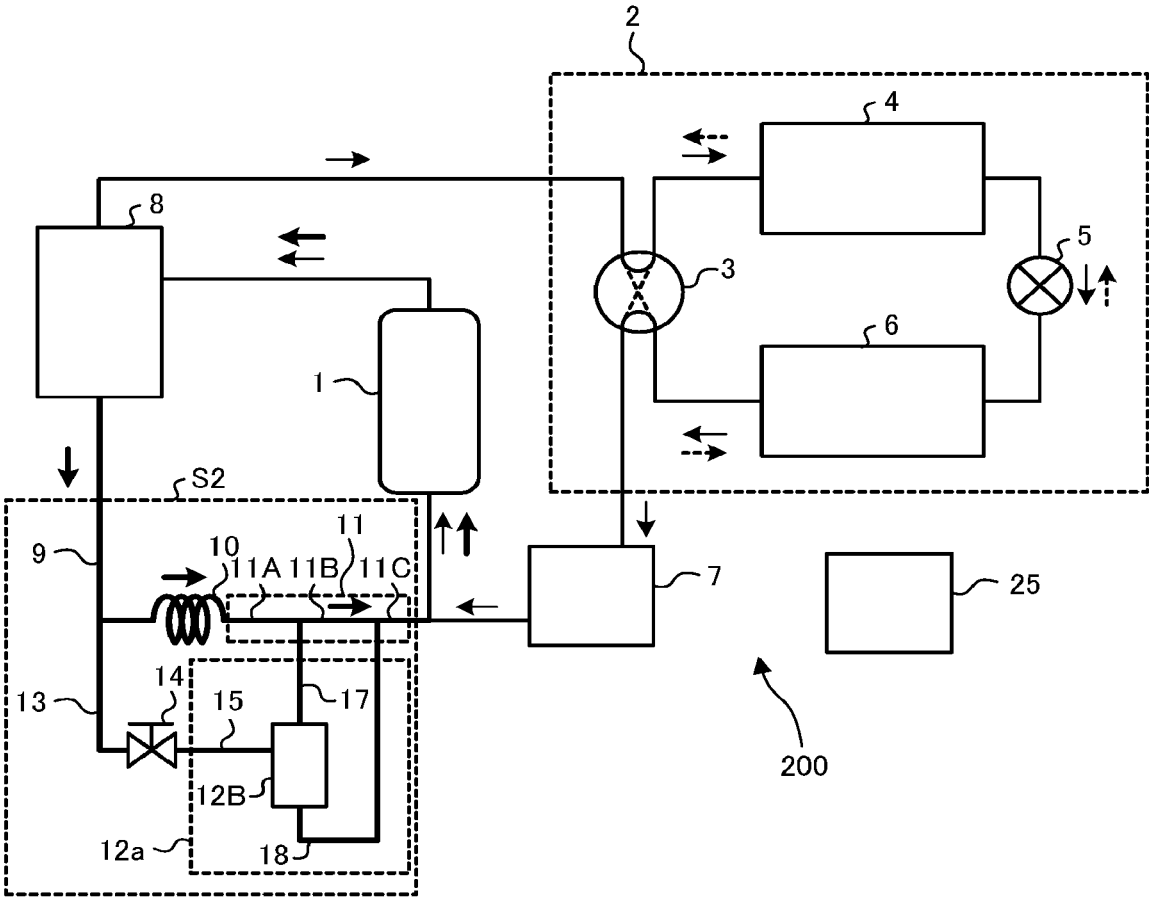
FIG. 2A is a schematic configuration diagram of a refrigeration cycle apparatus 200 according to Embodiment 2 of the present invention.

FIG. 2A is a schematic configuration diagram of a refrigeration cycle apparatus 200 according to Embodiment 2 of the present invention. Components having the same functions and operations as in Embodiment 1 are designated by the same reference signs, and the description thereof is omitted.

An oil return portion S2 of the refrigeration cycle apparatus 200 according to Embodiment 2 includes an oil reservoir container 12B instead of the oil reservoir pipe 12A, and further includes a fifth connection pipe 17 and a sixth connection pipe 18, in an oil reservoir portion 12*a*. The first opening and closing device 14 is provided on the fifth connection pipe 17.

The second connection pipe 11 of the oil return portion S2 is divided into a second connection pipe upstream portion 11A, a second connection pipe midstream portion 11B, and a second connection pipe downstream portion 11C. In addition, the flow control device 10 is connected at one end thereof to the first connection pipe 9 and is connected at another end thereof to one end of the second connection pipe upstream portion 11A.

The oil reservoir container 12B of the oil reservoir portion 12*a* is, for example, a container having a capacity adjusted to allow a required amount of the oil to be stored therein, and is configured to have a joint portion with a pipe in each of an upper portion and a lower portion thereof. The oil reservoir container 12B is connected at the upper portion thereof to the lower end of the fifth connection pipe 17 and the other end of the fourth connection pipe 15 and is connected at the lower portion thereof to one end of the sixth connection pipe 18.

The upper end of the fifth connection pipe 17 of the oil reservoir portion 12*a* is connected to the other end of the second connection pipe upstream portion 11A and one end of the second connection pipe midstream portion 11B. In addition, the upper end of the fifth connection pipe 17 is connected upward to the lower portions of the second connection pipe upstream portion 11A and the second connection pipe midstream portion 11B such that the oil flowing through the second connection pipe upstream portion 11A flows down to the fifth connection pipe 17 due to gravity fall during continuous operation.

The fifth connection pipe 17 does not employ a configuration that is formed in a U shape by bending as shown in FIG. 1B(b). In the pipe line in the fifth connection pipe 17, the refrigerating machine oil flows during continuous operation due to the action of gravity, not due to action of pressure difference. Thus, with the configuration shown in FIG. 1B(b), the refrigerating machine oil becomes stuck in some cases. To avoid this, the fifth connection pipe 17 is formed so as to extend from the lower side to the upper side over the range from the lower end, at which the fifth connection pipe 17 is connected to the oil reservoir container 12B, to the upper end, at which the fifth connection pipe 17 is connected to the second connection pipe upstream portion 11A and the second connection pipe midstream portion 11B.

The sixth connection pipe 18 of the oil reservoir portion 12*a* is connected at one end thereof to a lower portion of the oil reservoir container 12B and is connected at another end thereof to the other end of the second connection pipe midstream portion 11B and one end of the second connection pipe downstream portion 11C, that is, the refrigerant suction side of the compressor 1. The sixth connection pipe 18 has a pipe diameter adjusted such that the flow path resistance thereof is lower than the flow path resistance of the fifth connection pipe 17.

The second connection pipe upstream portion 11A is connected at one end thereof to the other end of the flow control device 10 and is connected at another end thereof to the one end of the second connection pipe midstream portion 11B and the upper end of the fifth connection pipe 17. The second connection pipe upstream portion 11A has a pipe diameter adjusted such that the flow path resistance thereof is lower than the flow path resistance of the flow control device 10.

The second connection pipe midstream portion 11B is connected at one end thereof to the other end of the second connection pipe upstream portion 11A and the upper end of the fifth connection pipe 17 and is connected at another end thereof to the one end of the second connection pipe downstream portion 11C and the other end of the sixth connection pipe 18. The second connection pipe midstream portion 11B has a pipe diameter adjusted such that the flow path resistance thereof is lower than the flow path resistance of the flow control device 10.

The second connection pipe midstream portion 11B has a pipe diameter adjusted such that the flow path resistance thereof is sufficiently lower than the flow path resistance within the oil reservoir portion 12*a*. This is for, during continuous operation, preventing the pressure difference from the joint portion of the second connection pipe midstream portion 11B with the fifth connection pipe 17 to the joint portion of the second connection pipe midstream portion 11B with the other end of the sixth connection pipe 18, from exceeding the head difference of the refrigerating machine oil accumulated within the oil reservoir portion 12*a* thereby to cause flow in which the refrigerating machine oil and the refrigerant flow from the upper end of the fifth connection pipe 17 within the oil reservoir portion 12*a* through the oil reservoir container 12B to the one end of the sixth connection pipe 18 and further flow through the sixth connection pipe 18 to the suction side of the compressor 1.

The second connection pipe downstream portion 11C is connected at one end thereof to the other end of the second connection pipe midstream portion 11B and the other end of the sixth connection pipe 18 and is connected at another end thereof to the suction side of the compressor 1 and the outflow side of the accumulator 7. The second connection pipe downstream portion 11C has a pipe diameter adjusted such that the flow path resistance thereof is lower than the flow path resistance of the flow control device 10.

[Description of Operation of Refrigeration Cycle Apparatus 200]

Figure 2B:
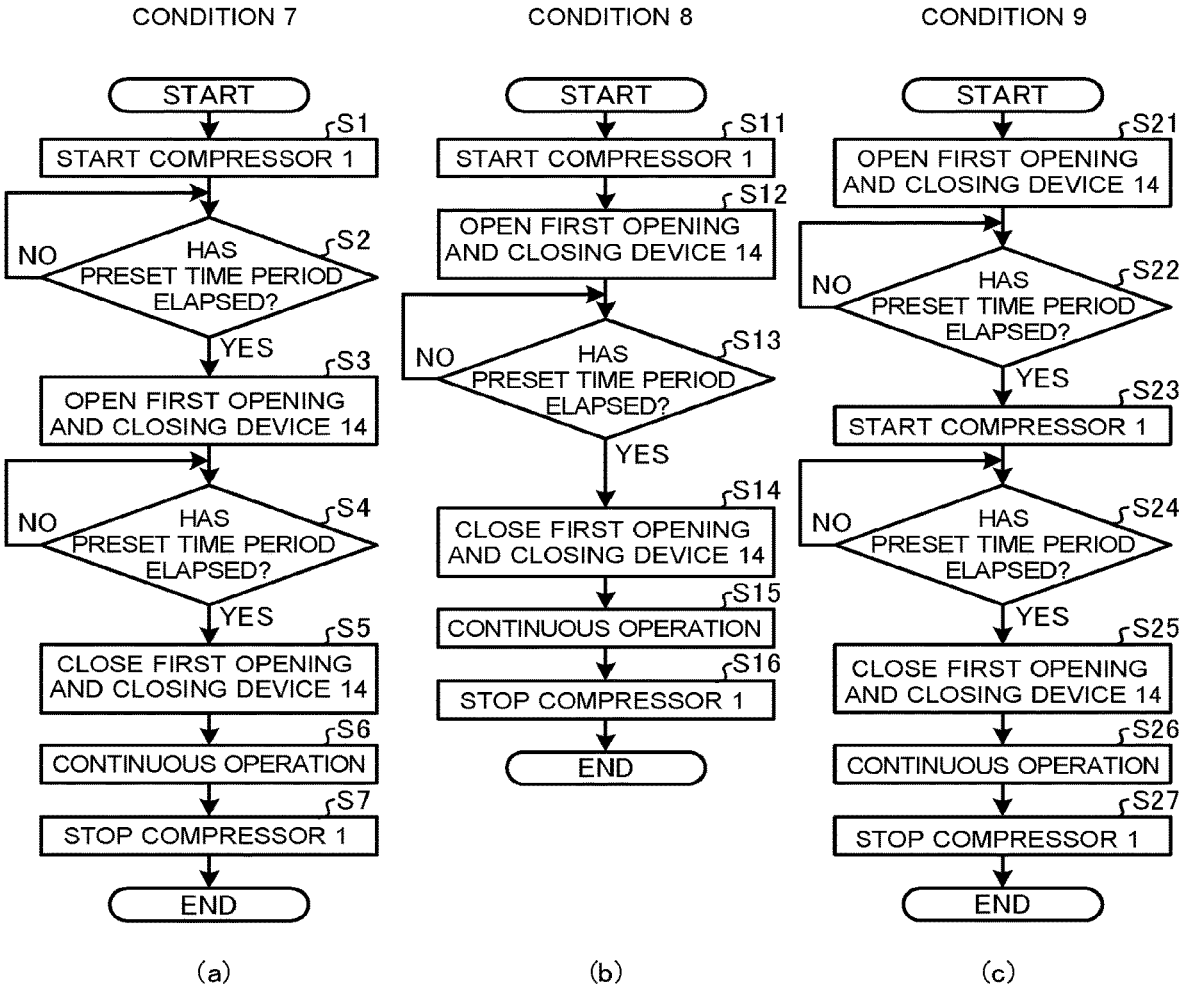
FIG. 2B is a flowchart showing an example of control of the refrigeration cycle apparatus 200 according to Embodiment 2 of the present invention.

FIG. 2B is a flowchart showing an example of control of the refrigeration cycle apparatus 200 according to Embodiment 2 of the present invention. FIG. 2B is the same as the control flowchart described with reference to FIG. 1C. Operation of the refrigeration cycle apparatus 200 will be described with reference to FIG. 2B.

Similar to Embodiment 1, in the case of starting the compressor 1, the first opening and closing device 14 is opened. Here, the case where the controller 25 uses Condition 7 in FIG. 2B(a) will be described as an example. As shown in FIG. 2B(a), the first opening and closing device 14 is opened for a preset time period, and the first opening and closing device 14 is closed during continuous operation and during stop. During continuous operation of the compressor 1, the refrigerating machine oil within the compressor 1 is discharged together with the refrigerant gas, is separated in the oil separator 8, and flows through the first connection pipe 9, the flow control device 10, and the second connection pipe upstream portion 11A in order, part of the refrigerating machine oil flows down through the fifth connection pipe 17 to the oil reservoir container 12B due to gravity fall, and the other refrigerating machine oil flows through the second connection pipe midstream portion 11B and the second connection pipe downstream portion 11C and is returned through the pipe at the suction side of the compressor 1 into the compressor 1.

At this time, not only the refrigerating machine oil but also part of the refrigerant gas flow into the flow control device 10 the throttling of which is adjusted, via the first connection pipe 9. Accordingly, it is possible to avoid overflow of the separated refrigerating machine oil in the oil separator 8.

Part of the refrigerating machine oil flowing from the second connection pipe upstream portion 11A into the oil reservoir portion 12*a* accumulates due to gravity fall until the oil surface reaches a position obtained by subtracting the head difference of the refrigerating machine oil equivalent to the pressure difference from the one end to the other end of the second connection pipe midstream portion 11B, from the upper end of the fifth connection pipe 17.

Thereafter, the oil does not accumulate within the oil reservoir portion 12, and the amounts of the oil flowing through the second connection pipe upstream portion 11A and the second connection pipe downstream portion 11C become equal to each other. Even when the compressor 1 is stopped in this state, the oil is kept accumulated within the oil reservoir portion 12.

Thereafter, when the first opening and closing device 14 is opened when the compressor 1 is started, flow occurs in which the refrigerant flows from the fourth connection pipe 15 through the oil reservoir container 12B, the fifth connection pipe 17, the second connection pipe midstream portion 11B, the second connection pipe downstream portion 11C, and the suction pipe of the compressor 1 into the compressor 1 due to the pressure difference between the discharge side and the suction side of the compressor 1. Similarly, when the first opening and closing device 14 is opened when the compressor 1 is started, flow occurs in which the refrigerant flows from the fourth connection pipe 15 through the oil reservoir container 12B, the sixth connection pipe 18, the second connection pipe downstream portion 11C, and the suction pipe of the compressor 1 into the compressor 1 due to the pressure difference between the discharge side and the suction side of the compressor 1. Here, since the flow path resistance of the fifth connection pipe 17 is higher than the flow path resistance of the sixth connection pipe 18, flow of the refrigerating machine oil through the sixth connection pipe 18 increases, and the refrigerating machine oil within the oil reservoir container 12B flows through the sixth connection pipe 18, the second connection pipe downstream portion 11C, and the suction side pipe of the compressor 1 into the compressor 1.

In the case where a flow control valve is used instead of the flow control device 10, while the refrigerating machine oil is stored within the oil reservoir portion 12*a* during continuous operation, the opening degree of the flow control valve is adjusted such that at least part of the refrigerant gas also flows together with the refrigerating machine oil through the first connection pipe 9 and the second connection pipe 11.

[Advantageous Effects of Refrigeration Cycle Apparatus 200 According to Embodiment 2]

In the refrigeration cycle apparatus 200 according to Embodiment 2, it is possible to obtain the same advantageous effects as in the refrigeration cycle apparatus 100 according to Embodiment 1. In addition, since the refrigeration cycle apparatus 200 includes the oil reservoir container 12B instead of the oil reservoir pipe 12A, even when the oil reservoir container 12B has the same internal capacity as the oil reservoir pipe 12A, the oil reservoir container 12B has a smaller external volume required for installation than the oil reservoir pipe 12A that tends to be larger in size or length, and thus it is possible to obtain a refrigeration cycle apparatus 200 smaller in size than the refrigeration cycle apparatus 100 according to Embodiment 1.

[Modification 1 of Embodiment 2]

Figure 2C:
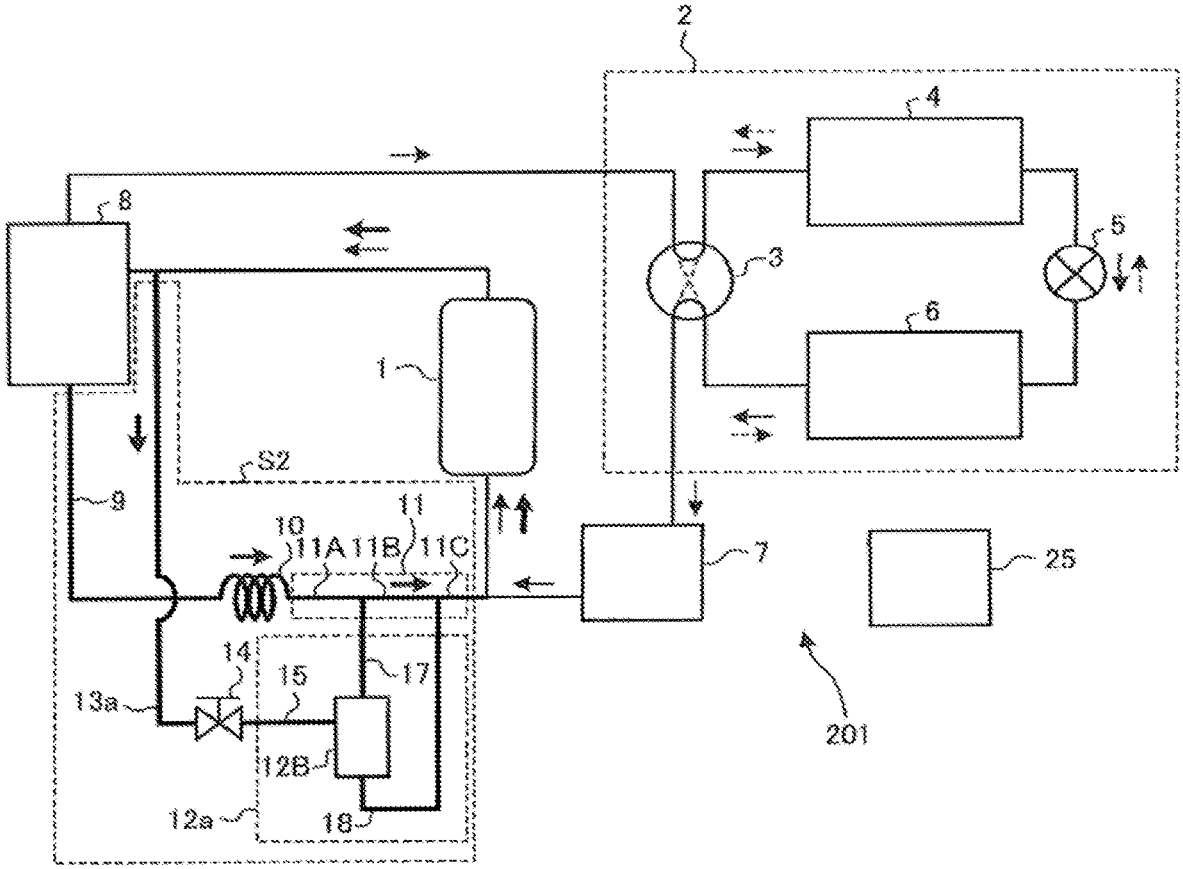
FIG. 2C is a schematic configuration diagram showing Modification 1 of the refrigeration cycle apparatus 200 according to Embodiment 2 of the present invention.

FIG. 2C is a schematic configuration diagram showing Modification 1 of the refrigeration cycle apparatus 200 according to Embodiment 2 of the present invention. Components having the same functions and operations as in Embodiment 2 are designated by the same reference signs, and the description thereof is omitted. As shown in FIG. 2C, a refrigeration cycle apparatus 201 includes, instead of the third connection pipe 13, a third connection pipe 13*a* that is connected at one end thereof so as to branch from a pipe connecting the refrigerant discharge side of the compressor 1 and the oil separator 8 and is connected at another end thereof to the first opening and closing device 14. The refrigeration cycle apparatus 201 according to Modification 1 executes the same control as the control of the refrigeration cycle apparatus 200 according to Embodiment 2 shown in FIG. 2B.

When the configuration of Modification 1 is used, it is possible to obtain the same advantageous effects as in the refrigeration cycle apparatus 200 according to Embodiment 2, as a substitute for the case where it is not possible to use the connection configuration of the third connection pipe 13 due to the structural limitations on the refrigeration cycle apparatus 201.

In the case of executing control of Condition 8 in FIG. 2B(b) and Condition 9 in FIG. 2B(c), the refrigeration cycle apparatus 201 according to Modification 1 opens the first opening and closing device 14, and then part of the refrigerant and the oil discharged from the compressor 1 is returned through the third connection pipe 13*a* and the oil reservoir portion 12*a* to the compressor 1. Thus, the amounts of the refrigerant and the oil flowing into the oil separator 8 decrease. In the refrigeration cycle apparatus 200 according to Embodiment 2, when the amount of the refrigerant and the oil flowing into the oil separator 8 is excessively large, the oil may scatter or accumulate within the oil separator 8, the oil separation efficiency may decrease, and the oil may flow to the refrigerant main pipe line 2. Therefore, the refrigeration cycle apparatus 201 according to Modification 1 is able to more assuredly inhibit poor lubrication of the compressor 1 in the case of executing control of Condition 8 and Condition 9.

Embodiment 3

Figure 3A:
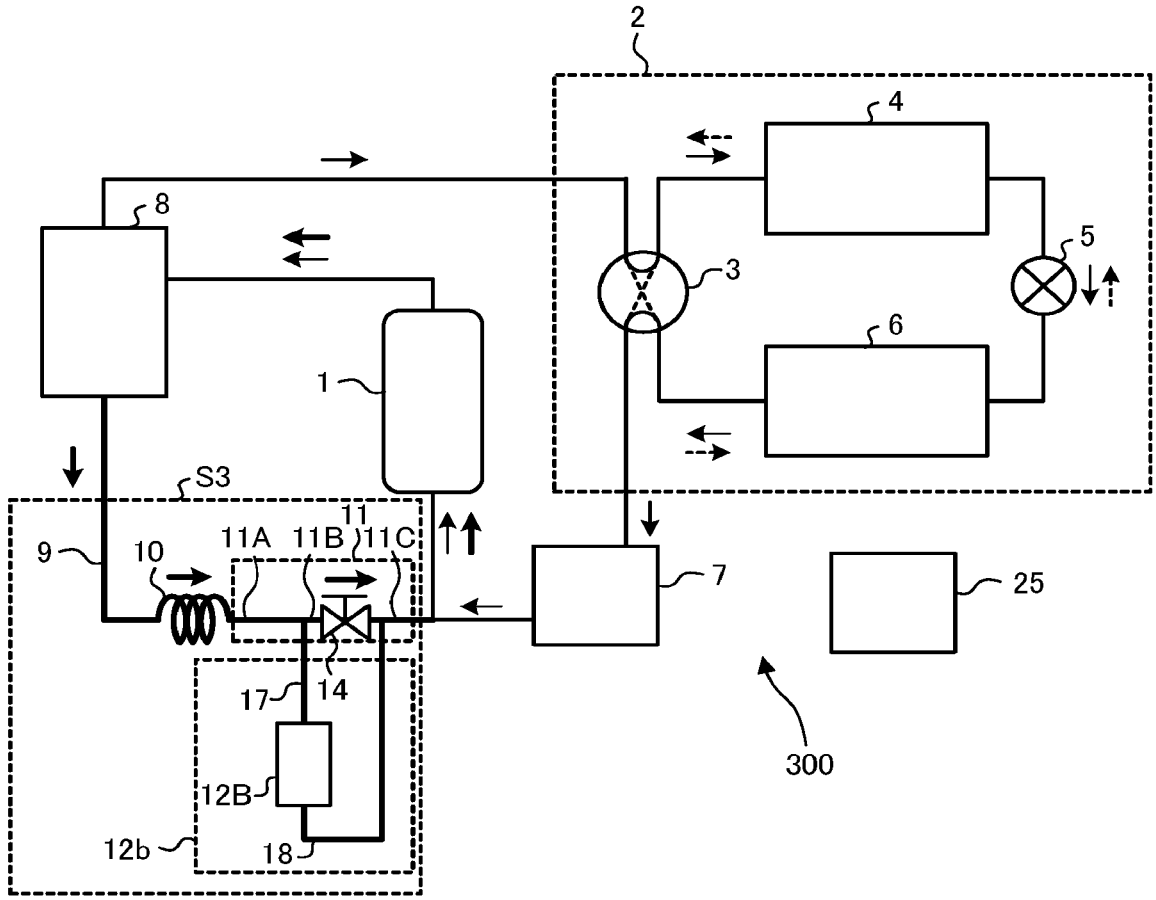
FIG. 3A is a schematic configuration diagram of a refrigeration cycle apparatus 300 according to Embodiment 3 of the present invention.

FIG. 3A is a schematic configuration diagram of a refrigeration cycle apparatus 300 according to Embodiment 3 of the present invention. Components having the same functions and operations as in Embodiments 1 and 2 are designated by the same reference signs, and the description thereof is omitted.

An oil return portion S3 of the refrigeration cycle apparatus 300 according to Embodiment 3 does not include a fourth connection pipe 15, includes an oil reservoir container 12B instead of the oil reservoir pipe 12A, and further includes a fifth connection pipe 17 and sixth connection pipe 18, in an oil reservoir portion 12*b*. In addition, the oil return portion S3 does not include a third connection pipe 13, and the second connection pipe 11 is divided into a second connection pipe upstream portion 11A, a second connection pipe midstream portion 11B, and a second connection pipe downstream portion 11C. The first opening and closing device 14 of Embodiment 3 is included in the second connection pipe midstream portion 11B. The first opening and closing device 14 of the refrigeration cycle apparatus 300 according to Embodiment 3 is closed when the compressor 1 is started, and is opened during continuous operation of the compressor 1.

The oil reservoir container 12B of the oil reservoir portion 12*b* is, for example, a container having a capacity adjusted to allow a required amount of the oil to be stored therein, and is configured to have a joint portion with a pipe in each of an upper portion and a lower portion thereof. The oil reservoir container 12B is connected at the upper portion thereof to the lower end of the fifth connection pipe 17 and is connected at the lower portion thereof to one end of the sixth connection pipe 18.

The second connection pipe midstream portion 11B includes the first opening and closing device 14. The second connection pipe midstream portion 11B is connected at one end thereof to the other end of the second connection pipe upstream portion 11A and the upper end of the fifth connection pipe 17 and is connected at another end thereof to the one end of the second connection pipe downstream portion 11C and the other end of the sixth connection pipe 18, that is, the refrigerant suction side of the compressor 1. The second connection pipe midstream portion 11B has a pipe diameter adjusted such that the flow path resistance thereof is lower than the flow path resistance of the flow control device 10.

The second connection pipe midstream portion 11B has a pipe diameter adjusted such that the flow path resistance of the first opening and closing device 14 and the pipe portion other than the first opening and closing device 14 is sufficiently lower than the flow path resistance within the oil reservoir portion 12*b*. This is for, in a state where the first opening and closing device 14 is opened during continuous operation, preventing the pressure difference from the joint portion of the second connection pipe midstream portion 11B with the fifth connection pipe 17 to the joint portion of the second connection pipe midstream portion 11B with the other end of the sixth connection pipe 18, from exceeding the head difference of the refrigerating machine oil accumulated within the oil reservoir portion 12*b* thereby to cause flow in which the refrigerating machine oil and the refrigerant flow from the upper end of the fifth connection pipe 17 within the oil reservoir portion 12*b* through the oil reservoir container 12B to the one end of the sixth connection pipe 18 and further flows through the sixth connection pipe 18 to the suction side of the compressor 1.

The refrigeration cycle apparatus 300 includes a controller 25 that closes the first opening and closing device 14 when the compressor 1 is started. The controller 25 is composed of, for example, a microcomputer, and executes control of a rotation speed, including operation and stop, of the compressor 1, control of the opening degree of the expansion device 5, control of switching of the refrigerant flow path switching device 3, and opening and closing control of the first opening and closing device 14. In addition, the controller 25 has, for example, a clocking function, and is configured to be able to operate the compressor 1 or control opening/closing of the first opening and closing device 14 at preset timing.

[Description of Operation of Refrigeration Cycle Apparatus 300]

Figure 3B:
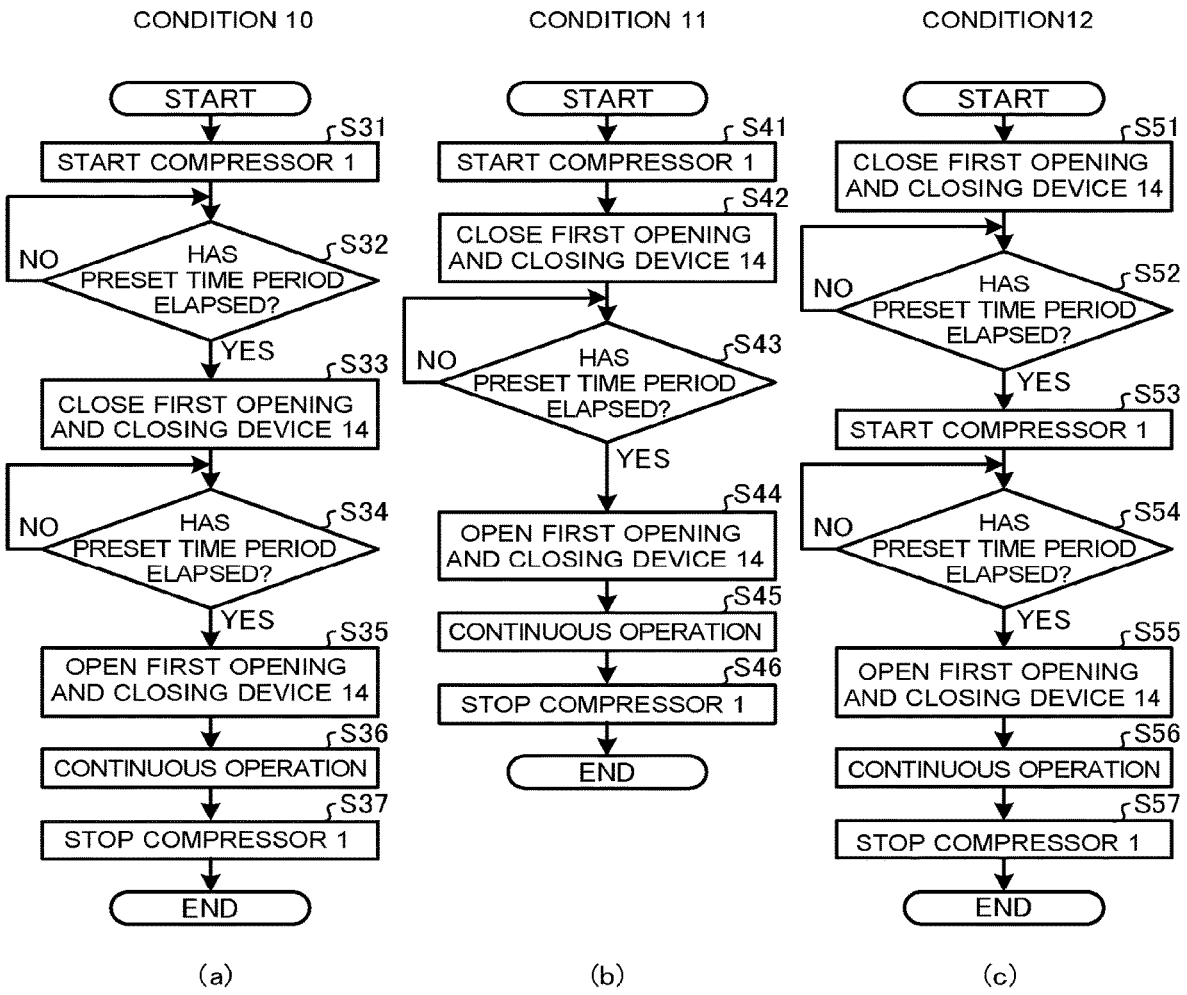
FIG. 3B is a flowchart showing an example of control of the refrigeration cycle apparatus 300 according to Embodiment 3 of the present invention.

FIG. 3B is a flowchart showing an example of control of the refrigeration cycle apparatus 300 according to Embodiment 3 of the present invention. With reference to FIG. 3B, operation of the refrigeration cycle apparatus 300 according to Embodiment 3 will be described. The refrigeration cycle apparatus 300 executes control according to Condition 10 (FIG. 3B(a)) corresponding to Condition 1 (FIG. 1C(a)) of the refrigeration cycle apparatus 100, Condition 11 (FIG. 3B(b)) corresponding to Condition 2 (FIG. 1C(b)), and Condition 12 (FIG. 3B(c)) corresponding to Condition 3 (FIG. 1C(c)).

The difference between FIG. 1C(a) to FIG. 1C(c) and FIG. 3B(a) to FIG. 3B(c) is as follows. As shown in FIG. 3B, each condition in the control flowchart for the refrigeration cycle apparatus 300 is different from that in FIG. 1C in that the opening operation and the closing operation of the first opening and closing device 14 are opposite. The other is the same as in FIG. 1C.

Similar to Embodiment 3, in the case of starting the compressor 1, the first opening and closing device 14 is closed. Here, the case where the controller 25 uses Condition 10 will be described as an example. As shown in FIG. 3B(a), the first opening and closing device 14 is opened for a preset time period, and the first opening and closing device 14 is opened during continuous operation and during stop. During continuous operation of the compressor 1, the refrigerating machine oil within the compressor 1 is discharged together with the refrigerant gas, is separated in the oil separator 8, and flows through the first connection pipe 9, the flow control device 10, and the second connection pipe upstream portion 11A in order, part of the refrigerating machine oil flows down through the fifth connection pipe 17 to the oil reservoir container 12B due to gravity fall, and the other refrigerating machine oil flows through the second connection pipe midstream portion 11B, including the first opening and closing device 14, and the second connection pipe downstream portion 11C and is returned through the pipe at the suction side of the compressor 1 into the compressor 1.

At this time, not only the refrigerating machine oil but also part of the refrigerant gas flow into the flow control device 10 the throttling of which is adjusted, via the first connection pipe 9. Accordingly, it is possible to avoid overflow of the separated refrigerating machine oil in the oil separator 8.

Part of the refrigerating machine oil flowing from the second connection pipe upstream portion 11A into the oil reservoir portion 12*b* accumulates due to gravity fall until the oil surface reaches a position obtained by subtracting the head difference of the refrigerating machine oil equivalent to the pressure difference from the one end to the other end of the second connection pipe midstream portion 11B, from the upper end of the fifth connection pipe 17.

Thereafter, the oil does not accumulate within the oil reservoir portion 12*b*, and the amounts of the refrigerating machine oil flowing through the second connection pipe upstream portion 11A and the second connection pipe downstream portion 11C become equal to each other. Even when the compressor 1 is stopped in this state, the oil is kept accumulated within the oil reservoir portion 12*b*.

Thereafter, when the first opening and closing device 14 is closed when the compressor 1 is started, the refrigerant and the refrigerating machine oil flow from the second connection pipe upstream portion 11A through the fifth connection pipe 17, the oil reservoir container 12B, the sixth connection pipe 18, the second connection pipe downstream portion 11C, and the suction pipe of the compressor 1 into the compressor 1 due to the pressure difference between the discharge side and the suction side of the compressor 1.

In the case where a flow control valve is used instead of the flow control device 10, while the refrigerating machine oil is stored within the oil reservoir portion 12*b* during continuous operation, the opening degree of the flow control valve is adjusted such that at least part of the refrigerant gas also flows together with the refrigerating machine oil through the first connection pipe 9 and the second connection pipe 11.

[Advantageous Effects of Refrigeration Cycle Apparatus 300 According to Embodiment 3]

In the refrigeration cycle apparatus 300 according to Embodiment 3, it is possible to obtain the same advantageous effects as in the refrigeration cycle apparatus 100 according to Embodiment 1. In addition, pipes such as the third connection pipe 13 and the fourth connection pipe 15 in Embodiment 1 are unnecessary, and it is possible to obtain a refrigeration cycle apparatus 300 smaller in size than the refrigeration cycle apparatus 100 according to Embodiment 1.

Embodiment 4

Figure 4A:
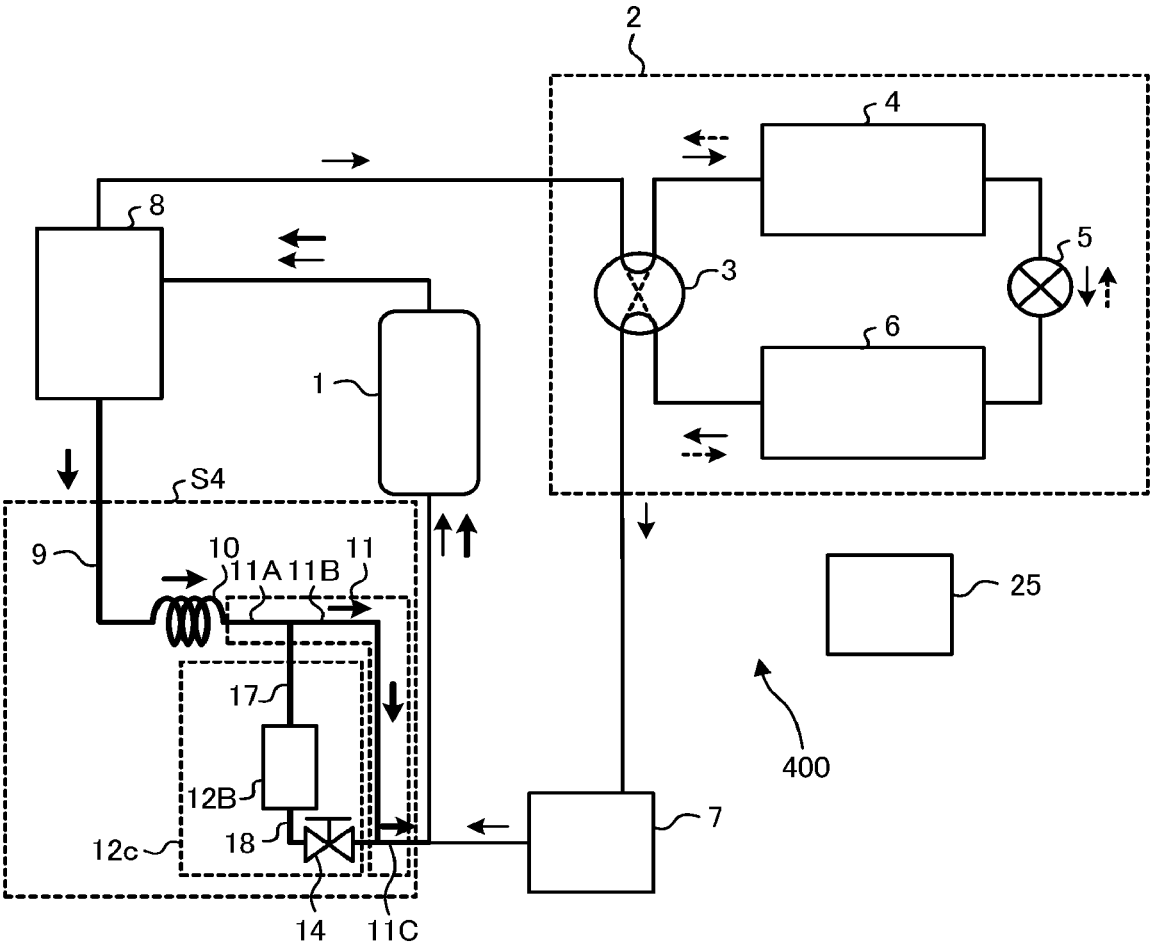
FIG. 4A is a schematic configuration diagram of a refrigeration cycle apparatus 400 according to Embodiment 4 of the present invention.

FIG. 4A is a schematic configuration diagram of a refrigeration cycle apparatus 400 according to Embodiment 4 of the present invention. Components having the same functions and operations as in Embodiments 1 to 3 are designated by the same reference signs, and the description thereof is omitted.

An oil return portion S4 of the refrigeration cycle apparatus 400 according to Embodiment 4 does not include a fourth connection pipe 15, includes an oil reservoir container 12B instead of the oil reservoir pipe 12A, and further includes a fifth connection pipe 17, in an oil reservoir portion 12*c*. In addition, the oil return portion S4 includes a sixth connection pipe 18 and does not include a third connection pipe 13, and the second connection pipe 11 is divided into a second connection pipe upstream portion 11A, a second connection pipe midstream portion 11B, and a second connection pipe downstream portion 11C. The first opening and closing device 14 of Embodiment 4 is included in the sixth connection pipe 18.

The first opening and closing device 14 of the refrigeration cycle apparatus 400 according to Embodiment 4 is opened at the time of start, and is closed during continuous operation.

The oil reservoir container 12B of the oil reservoir portion 12*c* is, for example, a container having a capacity adjusted to allow a required amount of the oil to be stored therein, and is configured to have a joint portion with a pipe in each of an upper portion and a lower portion. The oil reservoir container 12B is connected at the upper portion thereof to the lower end of the fifth connection pipe 17 and is connected at the lower portion thereof to the upper end of the sixth connection pipe 18.

The second connection pipe midstream portion 11B is connected at one end thereof to the other end of the second connection pipe upstream portion 11A and the upper end of the fifth connection pipe 17 and is connected at another end thereof to the one end of the second connection pipe downstream portion 11C and the lower end of the sixth connection pipe 18. The second connection pipe midstream portion 11B has a pipe diameter adjusted such that the flow path resistance thereof is lower than the flow path resistance of the flow control device 10.

The sixth connection pipe 18 includes the first opening and closing device 14. The sixth connection pipe 18 is connected at an upper end thereof to a lower portion of the oil reservoir container 12B and is connected at a lower end thereof to the other end of the second connection pipe midstream portion 11B and one end of the second connection pipe downstream portion 11C, that is, the refrigerant suction side of the compressor 1. The sixth connection pipe 18 does not employ a configuration that is formed in a U shape by bending as shown in FIG. 1B(b). In the pipe line in the sixth connection pipe 18, the refrigerating machine oil flows due to the action of gravity, not due to action of pressure difference, at the time of start. Thus, with the configuration shown in FIG. 1B(b), the refrigerating machine oil becomes stuck in some cases. To avoid this, the sixth connection pipe 18 is formed so as to extend from the lower side to the upper side over the range from the lower end, at which the sixth connection pipe 18 is connected to the one end of the second connection pipe downstream portion 11C, to the upper end, at which the sixth connection pipe 18 is connected to the lower portion of the oil reservoir container 12B. The sixth connection pipe 18 may be formed in a straight shape as shown in FIG. 1B(a), or may be formed such that a curved portion is formed, for example, by meandering as shown in FIG. 1B(c).

[Description of Operation of Refrigeration Cycle Apparatus 400]

Figure 4B:
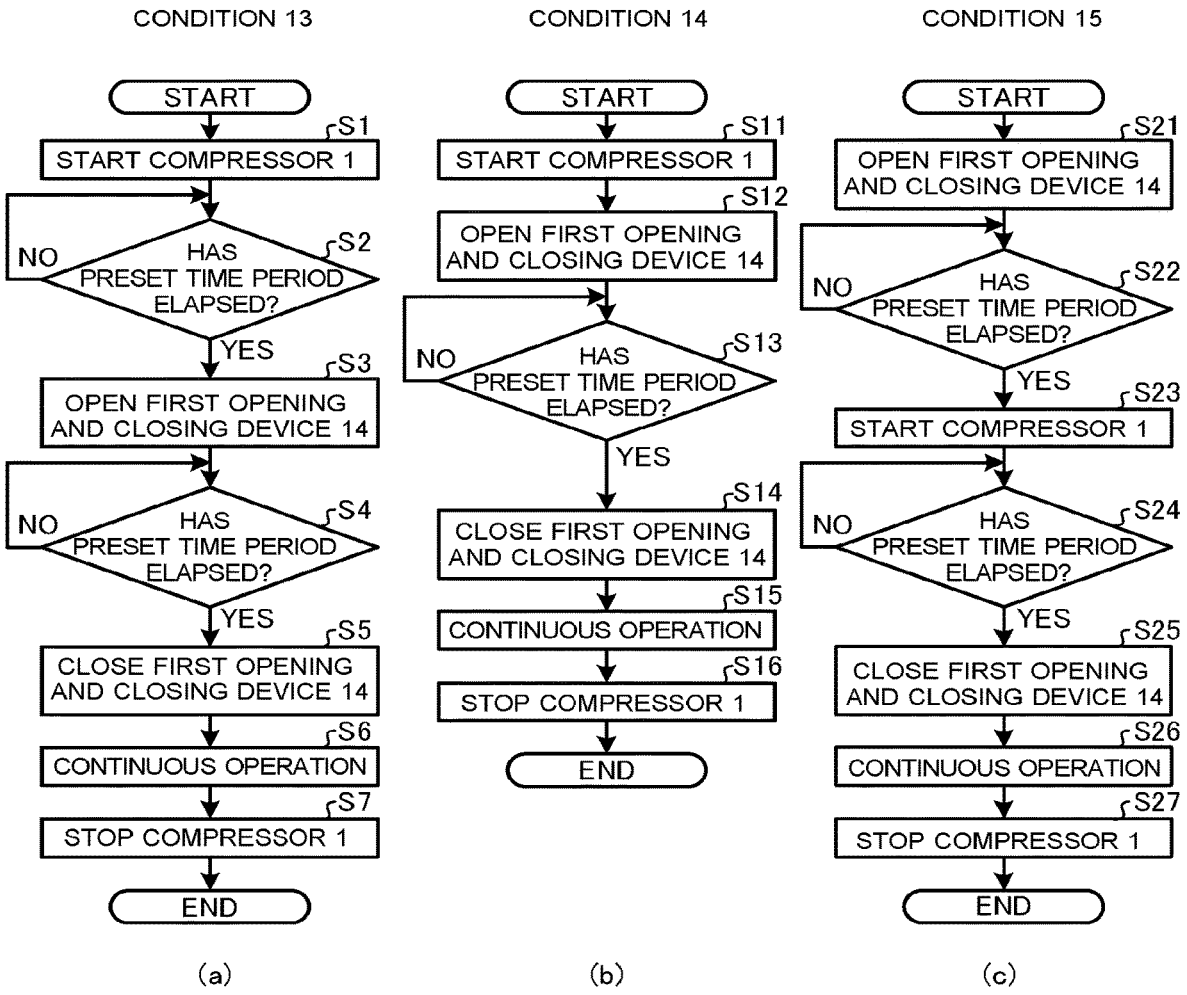
FIG. 4B is a flowchart showing an example of control of the refrigeration cycle apparatus 400 according to Embodiment 4 of the present invention.

FIG. 4B is a flowchart showing an example of control of the refrigeration cycle apparatus 400 according to Embodiment 4 of the present invention. FIG. 4B is the same as the control flowchart described with reference to FIG. 1C. Operation of the refrigeration cycle apparatus 400 according to Embodiment 4 will be described with reference to FIG. 4B.

Similar to Embodiment 1, in the case of starting the compressor 1, the first opening and closing device 14 is opened. Here, the case where the controller 25 uses Condition 13 will be described as an example. As shown in FIG. 4B(a), the first opening and closing device 14 is opened for a preset time period, and the first opening and closing device 14 is closed during continuous operation and during stop. During continuous operation of the compressor 1, the refrigerating machine oil within the compressor 1 is discharged together with the refrigerant gas, is separated in the oil separator 8, and flows through the first connection pipe 9, the flow control device 10, and the second connection pipe upstream portion 11A in order, part of the refrigerating machine oil flows down through the fifth connection pipe 17 to the oil reservoir container 12B due to gravity fall, and the other refrigerating machine oil flows through the second connection pipe midstream portion 11B and the second connection pipe downstream portion 11C and is returned through the pipe at the suction side of the compressor 1 into the compressor 1.

At this time, not only the refrigerating machine oil but also part of the refrigerant gas flow into the flow control device 10 the throttling of which is adjusted, via the first connection pipe 9. Accordingly, it is possible to avoid overflow of the separated refrigerating machine oil in the oil separator 8.

Part of the refrigerating machine oil flowing from the second connection pipe upstream portion 11A into the oil reservoir portion 12*c* accumulates due to gravity fall until the oil surface reaches the joint portion between the second connection pipe upstream portion 11A and the second connection pipe midstream portion 11B and the fifth connection pipe 17.

Thereafter, the oil does not accumulate within the oil reservoir portion 12*c*, and the amounts of the oil flowing through the second connection pipe upstream portion 11A and the second connection pipe downstream portion 110 become equal to each other. Even when the compressor 1 is stopped in this state, the oil is kept accumulated within the oil reservoir portion 12*c*.

Thereafter, when the first opening and closing device 14 is opened when the compressor 1 is started, the refrigerating machine oil stored within the oil reservoir container 12B flows through the sixth connection pipe 18 to the second connection pipe downstream portion 11C due to gravity, joins the refrigerant having flowed through the second connection pipe upstream portion 11A, the second connection pipe midstream portion 11B, and the second connection pipe downstream portion 11C, and flows through the suction side pipe of the compressor 1 into the compressor 1.

In the case where a flow control valve is used instead of the flow control device 10, while the refrigerating machine oil is stored within the oil reservoir portion 12*c* during continuous operation, the opening degree of the flow control valve is adjusted such that at least part of the refrigerant gas also flows together with the refrigerating machine oil through the first connection pipe 9 and the second connection pipe 11.

[Advantageous Effects of Refrigeration Cycle Apparatus 400 According to Embodiment 4]

In the refrigeration cycle apparatus 400 according to Embodiment 4, it is possible to obtain the same advantageous effects as in the refrigeration cycle apparatus 100 according to Embodiment 1. In addition, pipes such as the third connection pipe 13 and the fourth connection pipe 15 in Embodiment 1 are unnecessary, and it is possible to obtain a refrigeration cycle apparatus 400 smaller in size than the refrigeration cycle apparatus 100 according to Embodiment 1.

[Modification 1 of Embodiment 4]

Figure 4C:
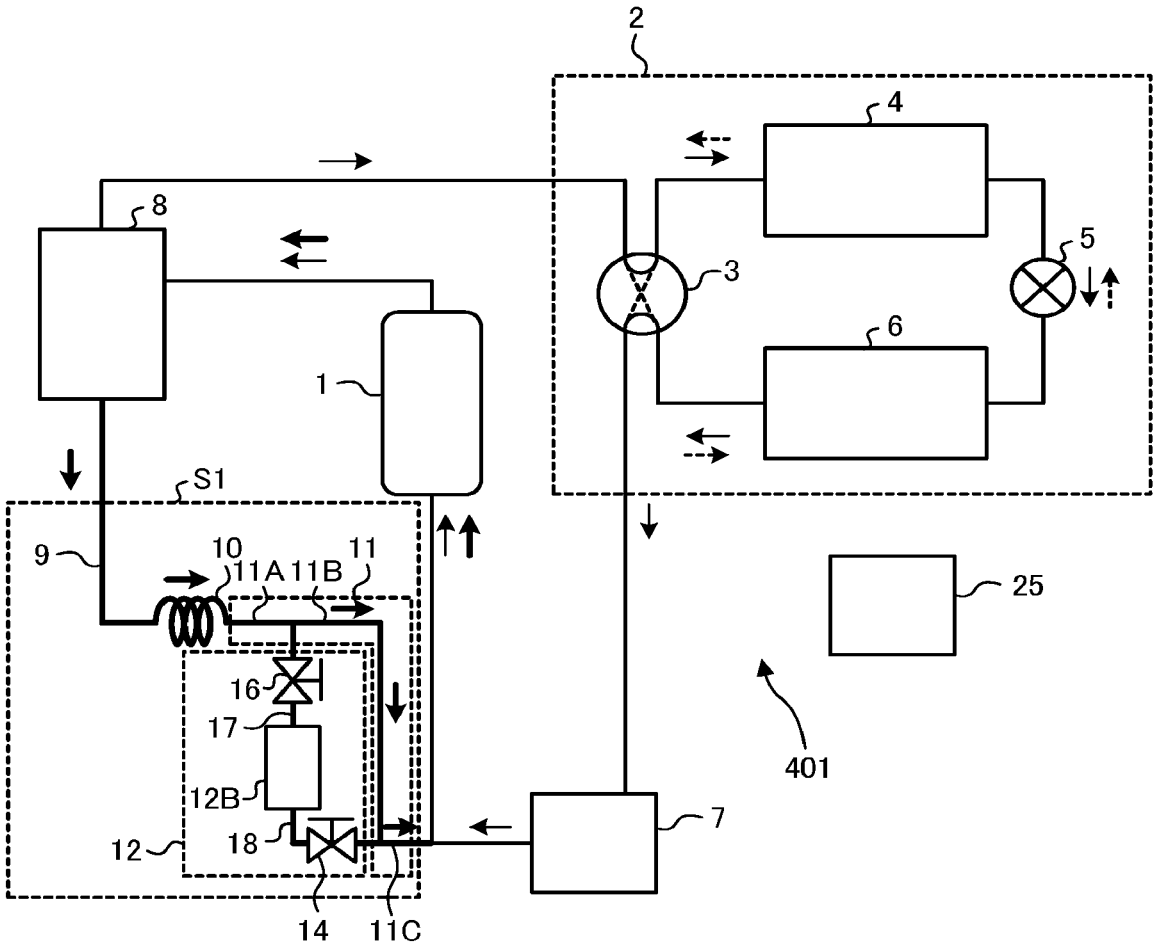
FIG. 4C is a schematic configuration diagram showing Modification 1 of the refrigeration cycle apparatus 400 according to Embodiment 4 of the present invention.

FIG. 4C is a schematic configuration diagram showing Modification 1 of the refrigeration cycle apparatus 400 according to Embodiment 4 of the present invention. Components having the same functions and operations as in Embodiment 4 are designated by the same reference signs, and the description thereof is omitted. As shown in FIG. 4C, a refrigeration cycle apparatus 401 includes a second opening and closing device 16 on a fifth connection pipe 17 provided in an oil return portion S5. The second opening and closing device 16 may be composed of, for example, a solenoid valve.

Figure 4D:
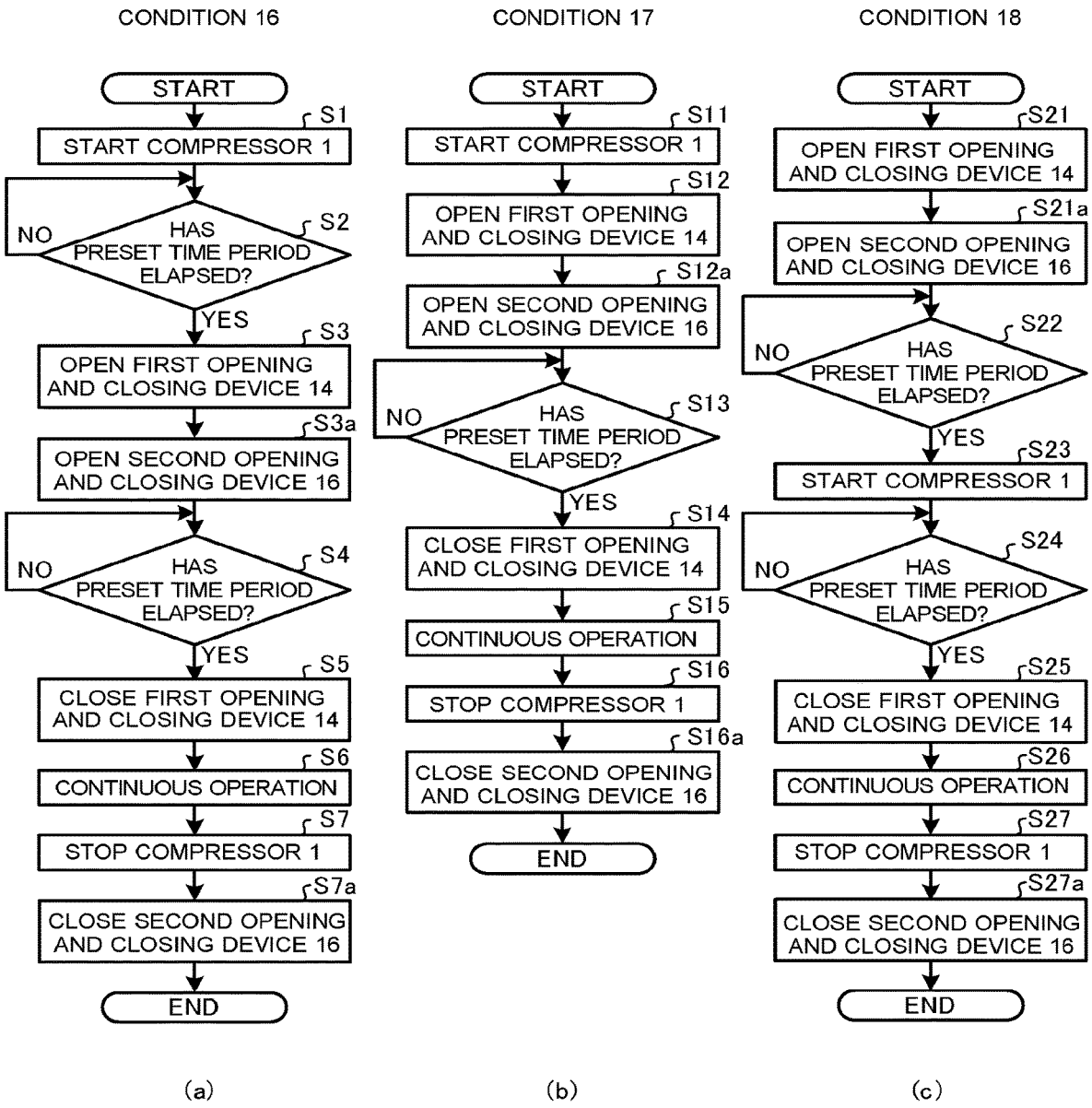
FIG. 4D is a flowchart showing an example of control of a refrigeration cycle apparatus 401 according to Embodiment 4 of the present invention.

FIG. 4D is a flowchart showing an example of control of the refrigeration cycle apparatus 401 according to Embodiment 4 of the present invention. With reference to FIG. 4D, operation of the refrigeration cycle apparatus 401 according to Modification 1 of Embodiment 4 will be described. The refrigeration cycle apparatus 401 also executes control according to Condition 16 (FIG. 4D(a)) corresponding to Condition 13 (FIG. 4B(a)) for control of the refrigeration cycle apparatus 400, Condition 17 (FIG. 4D(b)) corresponding to Condition 14 (FIG. 4B(b)), and Condition 18 (FIG. 4D(c)) corresponding to Condition 15 (FIG. 4B(c)).

The difference between FIG. 4B(a) to FIG. 4B(c) and FIG. 4D(a) to FIG. 4D(c) is as follows. FIG. 4D is different from FIG. 4B in that a step of opening and closing control of the second opening and closing device 16 is added to each condition in the control flowchart for the refrigeration cycle apparatus 101 in FIG. 4D. Specifically, in FIG. 4D(a), a step (step S3*a*) of opening the second opening and closing device 16 and a step (step S7*a*) of closing the second opening and closing device 16 are added. The other is the same as in FIG. 4B(a).

Also in FIG. 4D(b), similarly, (step S12*a*) and (step S16*a*) are added. Also in FIG. 4D(c), similarly, (step S21*a*) and (step S27*a*) are added.

As shown in FIG. 4D, the first opening and closing device 14 operates in the same manner as in Embodiment 4. In Modification 1 including the second opening and closing device 16, in the same case as shown in Condition 13 in FIG. 4B(a) of Embodiment 4, the controller 25 opens the first opening and closing device 14 and the second opening and closing device 16 after a preset time period has elapsed immediately after start of the compressor 1.

In the same case as shown in Condition 14 in FIG. 4B(b) of Embodiment 4, immediately after start of the compressor 1, that is, with start of the compressor 1, the first opening and closing device 14 and the second opening and closing device 16 are opened.

In the same case as shown in Condition 15 in FIG. 4B(c) of Embodiment 4, the compressor 1 is started after a preset time period has elapsed immediately after the first opening and closing device 14 and the second opening and closing device 16 are opened. The second opening and closing device 16 may be opened before the first opening and closing device 14 is opened.

The controller 25 opens the second opening and closing device 16 during continuous operation of the compressor 1. More specifically, the controller 25 starts the compressor 1 and opens the first opening and closing device 14 and the second opening and closing device 16, and then closes the first opening and closing device 14.

Furthermore, the controller 25 closes the second opening and closing device 16 during stop of the compressor 1.

When the configuration of Modification 1 is used, during stop of the compressor 1, the refrigerating machine oil within the oil reservoir portion 12 is maintained at a high concentration with respect to the refrigerant. That is, it is possible to maintain the refrigerating machine oil at a high concentration within the compressor 1 without the refrigerating machine oil within the oil reservoir portion 12 being diluted by the refrigerant. Therefore, in the refrigeration cycle apparatus 401 according to Modification 1, it is possible to more assuredly inhibit poor lubrication of the compressor 1.

The first connection pipe 9 and the second connection pipe 11 correspond to a "first oil return path" in the present invention. In addition, the third connection pipe 13, the fourth connection pipe 15, the fifth connection pipe 17, and the sixth connection pipe 18 correspond to a "second oil return path" in the present invention. Moreover, the oil reservoir pipe 12A and the oil reservoir container 12B correspond to an "oil reservoir" in the present invention.

REFERENCE SIGNS LIST

1 compressor 2 refrigerant pipe line 3 refrigerant flow path switching device 4 first heat exchanger 5 expansion device 6 second heat exchanger 7 accumulator 8 oil separator 9 first connection pipe 10 flow control device 11 second connection pipe 11A second connection pipe upstream portion 11B second connection pipe midstream portion 11C second connection pipe downstream portion 12 oil reservoir portion 12A oil reservoir pipe 12B oil reservoir container 12*a* oil reservoir portion 12*b* oil reservoir portion 12*c* oil reservoir portion 13, 13*a* third connection pipe 14 first opening and closing device 15 fourth connection pipe 16 second opening and closing device 17 fifth connection pipe 18 sixth connection pipe 25 controller 100 refrigeration cycle apparatus 101 refrigeration cycle apparatus 200 refrigeration cycle apparatus 300 refrigeration cycle apparatus 400 refrigeration cycle apparatus 401 refrigeration cycle apparatus S1 oil return portion S1*a* oil return portion S2 oil return portion S3 oil return portion S4 oil return portion

The invention claimed is:

1. A refrigeration cycle apparatus comprising:

a refrigerant circuit including a compressor, a condenser, an expansion device, and an evaporator;

an oil separator provided between the compressor and the condenser in the refrigerant circuit and configured to separate a refrigerating machine oil from refrigerant discharged from the compressor;

a first oil return path connected to the oil separator to cause the refrigerating machine oil separated by the oil separator and a portion of the refrigerant in the oil separator to flow into the first oil return path, connecting the oil separator to a refrigerant suction side of the compressor, and serving as a path for returning the refrigerating machine oil and the refrigerant to the compressor;

a flow control tube or valve provided on the first oil return path and configured to reduce pressure of the refrigerant and the refrigerating machine oil flowing into the first oil return path from the oil separator;

an oil reservoir provided so as to branch from the first oil return path between the flow control tube or valve and the refrigerant suction side of the compressor and configured to store the refrigerating machine oil;

a second oil return path on which the oil reservoir is provided and through which the oil accumulated in the oil reservoir flows when being returned to the compressor;

a first opening and closing valve provided on the first oil return path or the second oil return path and configured to control flow of the refrigerant and the refrigerating machine oil; and a controller configured to control the first opening and closing valve to return the refrigerating machine oil via the second oil return path to the refrigerant suction side of the compressor;

the oil reservoir being connected such that an upper end portion of the oil reservoir is branched downward from the first oil return path, of the refrigerating machine oil and the refrigerant flowing the first oil return path, a portion of the refrigerating machine oil is stored in the oil reservoir, the first oil return path being connected to the refrigerant suction side of the compressor such that the refrigerating machine oil not stored in the oil reservoir returns to the compressor.

2. The refrigeration cycle apparatus of claim 1, wherein the oil reservoir is connected at a lower portion thereof to the second oil return path, the first opening and closing valve is provided on the second oil return path, and the controller switches the first opening and closing valve to open when the compressor is started, and switches the first opening and closing valve to close after the refrigerating machine oil stored in the oil reservoir is returned to the compressor.

3. The refrigeration cycle apparatus of claim 2, further comprising a second opening and closing valve provided between the first oil return path and the oil reservoir and configured to close the oil reservoir.

4. The refrigeration cycle apparatus of claim 3, wherein the controller opens the second opening and closing valve when the compressor is started.

5. The refrigeration cycle apparatus of claim 3, wherein the controller closes the first opening and closing valve after the compressor is started and then the controller opens the first opening and closing valve and the second opening and closing valve.

6. The refrigeration cycle apparatus of claim 1, wherein the oil reservoir is connected at a lower portion thereof to the refrigerant suction side of the compressor via the second oil return path, the first opening and closing valve is provided on the first oil return path, and the controller switches the first opening and closing valve to close when the compressor is started, and switches the first opening and closing valve to open after the refrigerating machine oil stored in the oil reservoir is returned to the compressor.

7. The refrigeration cycle apparatus of claim 1, wherein the oil reservoir is connected at a lower portion thereof to the refrigerant suction side of the compressor via the second oil return path, the first opening and closing valve is provided on the second oil return path, and the controller switches the first opening and closing valve to open when the compressor is started, and switches the first opening and closing valve to close after the refrigerating machine oil stored in the oil reservoir is returned to the compressor.

8. The refrigeration cycle apparatus of claim 7, further comprising a second opening and closing valve provided between the first oil return path and the oil reservoir and configured to close the oil reservoir.

9. The refrigeration cycle apparatus of claim 8, wherein the controller opens the second opening and closing valve when the compressor is started.

10. The refrigeration cycle apparatus of claim 8, wherein the controller closes the first opening and closing valve after the compressor is started and then the controller opens the first opening and closing valve and the second opening and closing valve.

11. The refrigeration cycle apparatus of claim 1, wherein the oil reservoir has a pipe formed such that a curved portion is formed and extending in an up and down direction.

* * * * *